US005306611A

United States Patent [19]

Yagi et al.

[11] Patent Number: 5,306,611

[45] Date of Patent: Apr. 26, 1994

[54] SILVER HALIDE PHOTOGRAPHIC EMULSION MATERIALS

[75] Inventors: Toshihiko Yagi; Masaru Iwagaki; Toshiya Kondou; Hideo Akamatsu; Minoru Ishikawa, all of Hino, Japan

[73] Assignee: Konica Corporation, Tokyo, Japan

[21] Appl. No.: 931,897

[22] Filed: Aug. 18, 1992

Related U.S. Application Data

[63] Continuation of Ser. No. 619,175, Nov. 27, 1990, abandoned.

[30] Foreign Application Priority Data

Nov. 29, 1989 [JP] Japan ..... 1-309569
Jan. 12, 1990 [JP] Japan ..... 2-5227
Jan. 18, 1990 [JP] Japan ..... 2-9207

[51] Int. Cl.[5] ..... G03C 1/035
[52] U.S. Cl. ..... 430/567; 430/569
[58] Field of Search ..... 430/567, 569

[56] References Cited

U.S. PATENT DOCUMENTS 4,797,354 1/1989 Saitou et al. ..... 430/567
4,798,775 1/1989 Yagi et al. ..... 430/569
4,963,467 10/1990 Ishikawa et al. ..... 430/567
5,017,469 5/1991 Mowforth et al. ..... 430/567

FOREIGN PATENT DOCUMENTS 273411 7/1988 European Pat. Off. .

*Primary Examiner*—Janet C. Baxter
*Attorney, Agent, or Firm*—Jordan B. Bierman

[57] ABSTRACT

A novel photographic silver halide emulsion is disclosed, which is useful in a color photographic silver halide material to provide improvements in image quality, storage stability and pressure resistance. The photographic silver halide emulsion comprises silver halide twinned crystal grains each having a ratio of grain diameter to grain thickness of 5 or less which amount to 50% or more by projection area of total grains, wherein X-ray diffraction pattern of the twinned crystal grains with Cu-K$\alpha$ ray as a radiation source has a (420) diffraction signal having a single peak; and the width of the peak at a height of 0.13 times the maximum peak height, based on the signal intensity, is 1.5 degree or less in a diffraction angle, $2\theta$.

13 Claims, 5 Drawing Sheets

SILVER HALIDE PHOTOGRAPHIC EMULSION MATERIALS

This application is a continuation of application Ser. No. 07/619175, filed Nov. 27, 1990, now abandoned.

BACKGROUND OF THE INVENTION

The present invention relates to a silver halide photographic light-sensitive material, particularly to a silver halide photographic light-sensitive material improved in image quality, storage stability and pressure resistance and a silver halide photographic emulsion used in said light-sensitive material.

In recent years, there is a growing demand for a higher image quality in a silver halide color photographic light-sensitive material.

To meet the requirement for improved color reproducibility, a variety of studies have been made on development-inhibiting action between layers of different color sensitivities (inter-image effect).

In a color reversal light-sensitive material, studies have been made on enhancement of the inter-image effect in each of the first development (black and white development) and the second development (color development).

With respect to the second development, there is known a technique to incorporate a compound capable of releasing a developing inhibitor upon development, such as a DIR coupler, into a light-sensitive material; but, its effect is not satisfactory.

With respect to the first development, there have been proposed to incorporate a compound capable of releasing a developer upon development into a light-sensitive material. For example, DIR-hydroquinones are described in Japanese Patent Publication Open to Public Inspection No. 129536/1974 and U.S. Pat. Nos. 3,379,529, 3,620,746, 4,332,878, 4,377,634; DIR-aminophenols are described in Japanese Patent O.P.I. Publication No. 57828/1977; and p-nitrobenzyl derivatives are described in EP No. 45129.

Further, Japanese Patent O.P.I. Publication No. 213847/1986 discloses a compound which releases a photographically useful fragment while inducing an intramolecular oxidation-reduction reaction as a redox compound.

However, these compounds were not effective enough to improve the quality of images, in addition to a drawback of lowering the shelf-life of a light-sensitive material.

Regarding the 1st development, it is known that an inter-image effect which utilizes iodide ions released by development is useful. For example, techniques which use a fogged emulsion or an internally-fogged emulsion are disclosed in Japanese Patent Examined Publication No. 35011/1974 and Japanese Patent O.P.I. Publication No. 91946/1987. But, these techniques have a drawback of needing a larger amount of silver. Similarly, the inter-image effect using iodide ions can also be achieved by controlling the silver halide composition or silver halide grain structure in a silver halide emulsion of color sensitive layer. A proposal is made to use a tabular silver halide emulsion having a grain-diameter-to-grain-thickness ratio (aspect ratio) of 5 or more in Japanese Patent O.P.I. Publication Nos. 285549/1988 and 305355/1988. However, these techniques are still insufficient in providing satisfactory results, and a further improvement is strongly desired.

Generally, a silver halide used in a silver halide color photographic light-sensitive material is formed into grains, and then subjected to chemical sensitization for enhancing sensitivity and to spectral sensitization so as to be sensitive to light of a specific wavelength range.

A silver halide emulsion prepared as the above is subsequently coated on a support, using gelatin as a main binder, together with photographic additives such as a coupler, dye, etc. and dried to form a silver halide color photographic light-sensitive material. Said light-sensitive material is then exposed imagewise and developed to obtain desired images. But when a light-sensitive material is left unused for a long time from its preparation to imagewise exposing or exposed to a humid and hot atmosphere, generation of fog, desensitization and disordered gradation is observed at times.

This is attributed to change in a state of adsorption or desorption of various photographic additives, such as a sensitizing dye, chemical sensitizer, antifogging agent, development inhibitor and latent image stabilizer, which are adsorbed to the surface of silver halide grains.

To improve storage stability of such materials, studies have been made on selection of additive, improvement of addition method and adjustment of addition amount. But, an alteration of a type of silver halide requires an adjustment each time; besides, these approaches are not so effective.

Among silver halide emulsions, one which comprises regular crystals has a relatively good storage stability, but it tends to be affected by other silver halide grains contained in an adjacent layer; moreover, for its high sensitivity, the storage life is also liable to be lowered when a silver iodide content is raised.

Besides photographic properties such as sensitivity, gradation, image quality; and preservability of a fresh and developed materials; physical properties of a silver halide photographic light-sensitive material must be good enough to be handled. A light-sensitive material is subjected to pressure under various conditions in the course of manufacturing and distribution, or inside of exposing equipment or developing equipment. Generally, silver halides contained in a light-sensitive material lose their normal photographic characteristics when subjected to pressure, causing desensitization, sensitization at times, or fogging. Examples of such troubles are described in J.S.P. 2, 105 (1954) by P. Faelens et al.; J. Opt. Soc. Am. 38 1054 (1948) by K. B. Mather; and J.P.S. 4, 33, 127 (1985) by R. King et al.

When a light-sensitive material is pressed, scratched or rubbed on the surface, or subjected to folding or cutting, neighboring silver halide grains are pressed and yield an image density not corresponding to a given imagewise exposure, thereby quality of a finished image is impaired.

While pressure resistance can be improved to some extent by modifying a support which constitutes a light-sensitive material or a binder (gelatin and other hydrophilic polymers) which holds silver halides, it is largely depending on characteristics of silver halide grains.

For the improvement of the pressure resistance, studies have been made on various aspects such as halide composition of silver halide, halide distribution, method of chemical ripening, doping of metallic ions, selection of a sensitizing dye. But, most of the outcomes are accompanied with desensitization and inadequate for practical uses.

SUMMARY OF THE INVENTION

In view of the above conditions, the object of the present invention is to provide a silver halide color photographic material improved in quality of images particularly in color reproducibility.

Another object of the present invention is to provide a silver halide color photographic material improved in storage stability with a high sensitivity unchanged.

Further object of the present invention is to provide a silver halide color photographic material excellent in pressure resistance without any desensitization.

The above objects of the invention are achieved by a silver halide photographic emulsion, wherein 50% or more of projection area comprises of silver halide twinned crystal grains having a grain-diameter-to-grain-thickness ratio of 5 or below, said silver halide emulsion is of monodispersion, and its X-ray diffraction signal of (420) face with a radiation source of Cu Kα ray has a single peak, and the width of a diffraction signal at an angle of diffraction (2θ) is 1.5 degree or less at the maximum peak height times 0.13; and a silver halide photographic light-sensitive material in which said photographic emulsion is used.

DETAILED DESCRIPTION OF THE INVENTION

Figure 1:
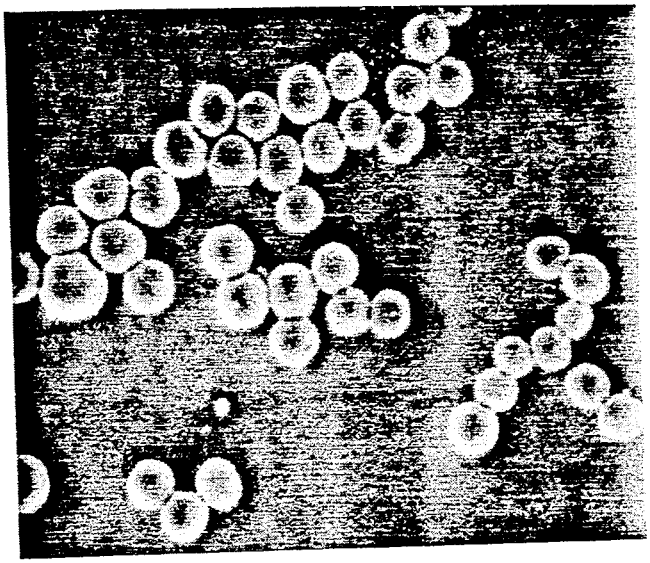
FIG. 1 is a photograph showing a spherical emulsion grain of Example 1 (20,000X magnification)

The present invention will be hereunder described in more details.

The term twinned crystal or twin used here means a silver halide crystal having one or more of twin planes in a single grain, and the classification of its configuration is described in the reports by E. Klein & E. Moisar on page 99, Vol. 99 of Photographishe Korrespondenz and page 57, Vol. 100 of the same. Two or more of twin planes in a twin grain may be parallel or not parallel to each other. The twin plane can be found with an electron microscope; it can also be observed from a cross-section of an ultra-thin specimen prepared by dispersing silver halide grains in a resin and solidifying it.

It is desirable that the silver halide twinned crystal grains of the invention are mostly composed of ones having two or more parallel twin planes. The more desirable are ones having an even number of twin planes, the most desirable are ones having two twin planes.

In the invention, the terms of "composed mostly of twin grains having two or more parallel twin planes" mean that twin grains having two or more parallel twin planes amount to 50% or more by number, desirably 60% or more, more desirably 70% or more, when the grains are counted from the largest one.

In the silver halide emulsion of the invention, 50% or more of the projection area is constituted by silver halide twinned crystal grains having a grain-diameter-to-grain-thickness ratio of 5 or less; and desirably, 70% or more, more desirably, 90% or more of the projection area is constituted by such grains. Further, the grain-diameter-to-grain-thickness ratio is desirably 1.0 to 4.5, more desirably 1.1 to 4.0. The term grain size used here means a diameter of a circular image converted into the same area from a projected image of a grain.

The projection area of a grain can be determined from the sum of grain areas. It can be determined by an electron-microscopic observation of silver halide crystals distributed on a sample bed not to overlap one another. The thickness of a grain can be determined by observing it obliquely with an electron microscope.

In the invention, the silver iodobromide emulsion composed mostly of twinned crystal grains is preferably a monodispersed one.

In the monodispersed silver halide emulsion of the invention, silver halide grains of which sizes are within a range of average grain size $\bar{d} \pm 20\%$ amount to 70% or more, desirably 80% or more, more desirably 90% or more by weight of the total silver halide.

The average grain size $\bar{d}$ is defined as the grain size $d_i$ at which the product of a frequency $n_i$ of grains having a grain size $d_i$ and $d_i^3$, namely $n_i \times d_i^3$, reaches the maximum. (a number of three significant figures, a figure on the last place is rounded)

The term grain size used here means a diameter when a projected image of a grain is converted into a circle of the same area.

The grain size can be determined, for example, by taking a photograph of said grain magnified to 10,000 to 50,000 times with an electron microscope and measuring the grain diameter or the projected area on the print. (the number of grains for measurement is to be more than 1,000 at random)

The monodispersed emulsion of the invention desirably has a distribution extent (or a coefficient of variation) of 20% or less, which is defined by $$\frac{\text{Grain size standard deviation}}{\text{Average grain size}} \times 100 = \text{Distribution extent } (\%)$$

A more desirable distribution extent is 15% or less, the most desirable one is 12% or less.

In the invention, the method of measuring grain size follows the foregoing measuring method, and an arithmetic mean value of measurements is taken as an average grain size as follows.

$$\text{Average grain size} = \frac{\Sigma dini}{\Sigma ni}$$

where ni is number of grains having a diameter of di.

The X-ray diffractiometry is known as a means to examine the crystal structure of a silver halide grain.

A variety of characteristic X-rays may be used as a radiation source. Of them, a Cu Kα ray using Cu as the target is most popular.

A silver iodobromide crystal has a rock salt structure, and a diffraction signal of a (420) face of the crystal is observed from 71 to 74 degree of 28 wherein θ is Bragg angle. Since the signal intensity is relatively strong and of high angle, it has a good resolving power and is best suited to examine the crystal structure.

In determining an X-ray diffraction of a photographic emulsion, it is necessary to remove gelatin, incorporate a standard sample such as silicone and then perform the determination by the powder method. Details of the procedure can be seen, for example, in Fundamental Analytical Chemistry Course 24 "X-ray Analysis" (Kyoritsu Publishing Co.).

In the invention, the silver iodobromide emulsion composed mostly of twinned crystal grains is characterized in that at a maximum peak height times 0.13 of a (420) diffraction signal using a Cu Kα ray as a radiation source, the peak width of the diffraction signal is 1.5 degree or less at an angle of 2θ. A more desirable signal width is 1.0 degree or less, the most desirable one is 0.90 degree or less.

Existence of the signal means here that at a maximum peak height times 0.13, the intensity of a signal is higher than that height. In the foregoing diffraction signal of a silver halide emulsion of the invention, an only peak appears. In counting the number of peaks, measured noises and peaks whose heights are 4% or less of the maximum peak height are excluded.

In the silver halide emulsion of the invention, when a horizontal line was drawn at the maximum peak height times 0.13 of a (420) diffraction signal using a radiation source of Cu Kα ray, and a line segment cut from the horizontal line by the signal is denoted by AA' and an intersection point made by AA' and a vertical line drawn downward from the peak point is denoted by B, the ratio of length-of-line-segment-AB-to-length-of-line-segment-BA' is desirably 1 or less; provided that the line segment AA' is drawn from a lower angle side of the diffraction angle to a higher angle converted side. Further, the ratio of length-of-line-segment-AB-to-length-of-line-segment-BA' is more desirably 0.95 or less, most desirably 0.6 to 0.90.

The silver halide twinned crystal grains of the invention desirably has both (111) faces and (100) faces. It is desirous that the (100) face amounts to 20% or more of the grain surface. More desirably, 30% or more; most desirably, the (100) face amounts to 40 to 70%. It is also desirable that faces other than (100) faces are mostly (111) faces.

The ratio of (100) face to (111) face can be determined by comparing the signal intensity ratios of (200) face, (222) face and (220) face of a silver halide grain sample distributed on a flat sample bed not to overlap one another with the signal ratios of (200) face, (222) face and (220) face of the powder sample.

In the silver halide emulsion of the invention, the average silver iodide content is desirably 6 mol % or less, more desirably 0 to 5 mol %, and most desirably 1 to 4 mol %.

The emulsion may contain silver chloride within the limits not to impair the effect of the invention.

The silver halide emulsion of the invention can be prepared by localizing silver iodide inside of grains. A preferable embodiment is an emulsion in which on an internal core having a high silver iodide content, silver iodobromide with a silver iodide content lower than the nucleus is deposited in a layered structure.

The silver iodide content of the internal core is desirably 18 to 45 mol %, more desirably 25 to 40 mol %.

It is desirous that 10 mol % or more of difference exists between silver iodide content of the outermost shell and that of the internal core. A more desirable difference is 20 mol % or more, the most desirable one is 30 to 40 mol %.

In the above embodiment, another silver halide phase may exist in the central portion of the internal core or between the internal core and the outermost shell.

The volume of the outermost shell is desirably 10 to 90 mol % of the total grain, more desirably 50 to 80 mol %. The silver halide phase in the internal nucleus, outermost shell and others may be any of an uniform composition, a group of phases in which each phase has an uniform composition and the composition of the group varies phase by phase, a continuous phase within which the composition changes continuously, or a combination thereof.

In another embodiment of the invention, the silver iodide content changes continuously from center of a grain to its outer portion, not forming a substantially uniform phase of silver iodide localized inside of a grain. In this case, it is preferred that the silver iodide content decreases flatly from a point where the silver halide content is the maximum to outer portion of a grain.

The silver iodide content at the point where the silver iodide content is the maximum is desirably 15 to 45 mol %, more desirably 25 to 40 mol %.

Further, the silver iodide content at the grain surface is desirably 3 mol % or less, more desirably 0 to 2 mol %, most desirably 0.1 to 1.0 mol %.

The silver halide emulsion of the invention can be favorably prepared by a method which deposits a phase containing silver iodobromide or silver bromide on monodispersed seed grains. The example of a particularly favorable method is that described in Japanese Patent O.P.I. Publication No. 6643/1986 which provides a growth process to feed up a spherical twinned crystal seed grain. In practice, in the method for manufacturing a silver halide photographic emulsion performed by feeding an aqueous solution of a silver salt and an aqueous solution of a halide in the presence of a protective colloid, an emulsion is prepared by steps of (1) providing a nuclear grain formation process which keeps pBr of a mother liquor from 2.0 to −0.7 for a period more than half of this process from the start of precipitation of silver halide having an silver iodide content of 0 to 5 mol %, and then (2) providing a seed grain formation process, where silver halide grains of substantially monodispersed spherical twin are formed in a mother liquor containing 10 to 2.0 mol/AgX of a silver halide solvent, subsequently (3) providing a growing process which feeds up seed grains with the addition of an aqueous solution of silver salt, an aqueous solution of halide and/or silver halide fine grains.

The mother liquor used here is a liquor used as a medium where preparation of a silver halide emulsion is carried out till a photographic emulsion is completed (including a silver halide emulsion).

Silver halide grains formed in the foregoing nuclear grain formation process consist of silver iodobromide twinned crystal grains containing 0 to 5 mol % of silver iodide.

Further, the outer wall of a crystal grain may consist of (111) faces, (100) faces or combination thereof.

In the invention, twinned crystal nuclear grains can be prepared by adding a water-soluble silver salt, or a water-soluble silver salt and a water-soluble halide, over a period of more than first half of the nuclear grain formation process, while keeping the bromide ion concentration in the aqueous protective colloidal solution normally 0.01 to 5 mol/l (or pBr from 2.0 to −0.7), desirably 0.03 to 5 mol/l (pBr from 1.5 to −0.7).

The nuclear grain formation process of the invention is not only a period from start of the addition of a water-soluble silver salt to a protective colloidal solution to termination of new crystalline nucleus formation, but the subsequent grain growth period may be included; therefore, this is defined as a process prior to the seed grain formation process.

In the invention, the size distribution of nuclear grains is not limited, and either monodispersion or polydispersion is usable. The term polydispersion here means those nuclear grains which have a coefficient of variation (the same as the foregoing distribution extent) of 25% or more. It is desirable for the nuclear grains of the invention to contain at least 50% by number of twinned crystal grains. A more desirable content is 70% or more, the most desirable one is 90% or more.

Next, the seed grain formation process will be described. In this process, nuclear grains prepared in the nuclear grain formation process are ripened in the presence of a solvent for silver halide, and seed grains comprising monodispersed spherical grains are formed.

Ripening in the presence of a solvent for silver halide (hereinafter abbreviated as ripening) is thought to be different from Ostwald ripening in which small grains are dissolved and large grains are grown when small grains and large ones coexist and thereby the distribution of grain size is regarded to be widened in general. Ripening of nuclear grains prepared in the nuclear grain formation process is performed by ripening an emulsion mother liquor, which undergone the above nuclear grain formation process for forming twinned crystal nuclear grains with the addition of silver halide containing 0 to 5 mol % of silver iodide, in the presence of $10^{-5}$ to 2.0 mol/mol Ag of a silver halide solvent. Thus, substantially monodispersed spherical seed grains can be obtained. The term substantially monodispersed means that the distribution extent defined above is 25% or less.

Further, the term substantially spherical means that when silver halide grains are observed with an electron microscopic photograph, faces such as (111) face or (100) face are rounded to the extent that they cannot be identified, and when three-dimensional axes crossing at right angles to one another are set at a point near the center of gravity of a grain, the ratio (C) of maximum-grain-diameter-L-to-minimum-grain-diameter-l in directions of length, width and height (C=L/l) is normally 1.0 to 2.0, desirably 1.0 to 1.5.

In the invention, said spherical grains amount to 60% or more of the total number of grains, more desirably 80% or more, most desirably almost all of that.

Examples of the silver halide solvent used in the seed grain formation process include (a) organic thioethers described in U.S. Pat. Nos. 3,271,157, 3,531,289, 3,574,628, Japanese Patent O.P.I. Publication Nos. 1019/1979, 158917/1979, and Japanese Patent Examined Publication No. 30571/1983, (b) thiourea derivatives described in Japanese Patent O.P.I. Publication Nos. 82408/1978, 29829/1980, and 77737/1980, (c) silver halide solvents having a thiocarbonyl group sandwiched between an oxygen or a sulfur atom and a nitrogen atom described in Japanese Patent O.P.I. Publication No. 144319/1978, (d) imidazoles described in Japanese Patent O.P.I. Publication No. 100717/1979, (e) sulfites, (f) thiocyanates, (g) ammonia, (h) ethylenediamines substituted with a hydroxyalkyl group described in Japanese Patent O.P.I. Publication No. 196228/1982, (i) substituted mercaptotetrazoles described in Japanese Patent O.P.I. Publication No. 202531/1982, (j) water-soluble bromides, and (k) benzimidazole derivatives described in Japanese Patent O.P.I. Publication No. 54333/1983.

Examples of these silver halide solvents (a) through (k) are as follows:

(a)

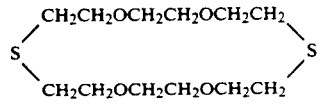

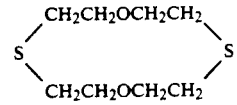

$HOCH_2CH_2SCH_2CH_2SCH_2CH_2OH$ $CH_2NHCOCH_2CH_2COOH$
$|$
$CH_2SCH_2CH_2SC_2H_5$ $CH_2NHCOC_3H_7$
$|$
$CH_2SCH_2CH_2SCH_2CH_2COOH$

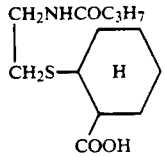

(b)

$(CH_3)_2N-C(=S)-N(CH_3)_2$ $(C_2H_5)_3N-C(=S)-N(C_2H_5)_2$

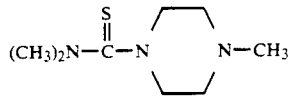

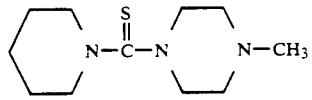

(c)

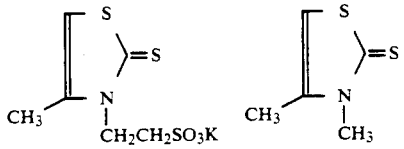

(d)

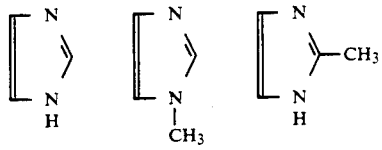

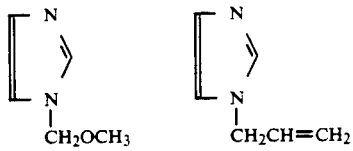

(e) $K_2SO_3$, $Ka_2SO_3$ (f) $NH_4SCN$, $KSCN$ (g) $NH_3$ (h) $(HOCH_2CH_2)_2NCH_2CH_2N(CH_2CH_2OH)_2$ .

-continued $(CH_3CHCH_2)_2NCH_2CH_2N(CH_2CHCH_3)_2$
OH OH $(C_2H_5)_2NCH_2CH_2N(CH_2CH_2OH)_2$ $(C_2H_5CHCH_2)_2NCH_2CH_2N(CH_2CHC_2H_5)_2$
OH OH (i)

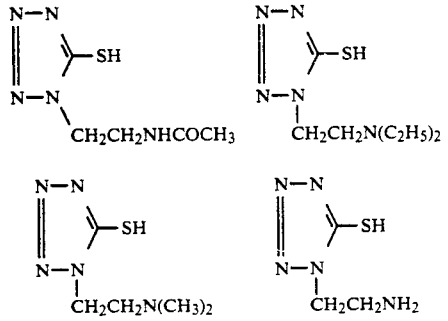

(j) NaBr, $NH_4Br$, KBr (k)

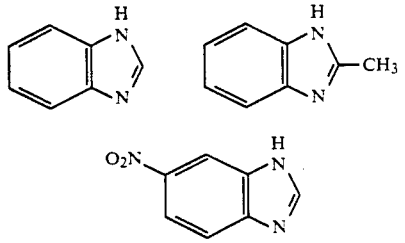

These solvents may be used in combination of two or more. Preferred solvents are thioethers, thiocyanates, thioureas, ammonia, bromides, and particularly preferred one is a combination of ammonia and a bromide.

These solvents are added in an amount of $10^{-5}$ to mols per mol of silver halide.

Further, preferred pH and temperature are 3 to 13 and to 70° C., respectively. Particularly preferred conditions are a pH of 6 to 12 and a temperature of 35° to 50° C.

An example of a preferable embodiment of the present invention is as follows: using 0.4 to 1.0 mol/l of ammonia and 0.03 to 0.5 mol/l of potassium bromide jointly, ripening was performed for a period between 30 seconds and 10 minutes at conditions of pH 10.8 to 11.2 and temperature 35° to 45° C., and thus emulsions containing preferable seed grains were prepared.

During the seed grain formation process of the invention, a water-soluble salt may be added to adjust the ripening.

The seed grain growth process to grow up silver halide seed grains is carried out by controlling pAg, pH, concentration of a silver halide solvent, composition of silver halide, addition speed of solutions of silver salts and halides during the process of precipitation and Ostwald ripening.

Preferred conditions for growing up the seed grains according to the invention can be seen in Japanese Patent O.P.I. Publication Nos. 39027/1976, 142329/1980, 113928/193, 48521/1979 and 49938/1983; that is, an aqueous solution of a silver salt and an aqueous solution of a halide are added by the double-jet method, while gradually changing the addition speed within the range not to cause new nuclei to generate as the grains are grown up and not to cause Ostwalt ripening to occur. Another method to grow up seed grains is seen on page 88 of the Summary of Reports Released in 1983 Annual Conference of the Society of Photographic Science and Technology of Japan, which comprises addition of silver halide fine grains followed by dissolution and recrystallization. But the former method is preferred.

Growth conditions of silver halide grains in preparing a silver halide emulsion of the invention are preferably pAg 5 to 11, temperature 40° to 85° C. and pH 1.5 to 5.8. A particularly preferred pAg range is 6.0 to 9.5, and a particularly preferred temperature range is 60° to 80° C.

In growing the grains, the aqueous solution of silver nitrate and the aqueous solution of halide re preferably added by the double-jet method. Iodide may be added in the system as silver iodide. The addition is favorably performed at a speed not to form new nuclei and not to cause widening of the distribution extent due to Ostwald ripening, namely within the range of 30 to 100% of a speed at which new nuclei are formed.

Concentration of an aqueous solution of silver nitrate used for growing a high silver iodide content phase (an internal nucleus) at the center of silver halide grains of the invention is desirably 1N or less, more desirably 0.3 to 0.8N.

In preparing a silver halide emulsion of the invention, the stirring at the manufacture is of critical importance. As a stirrer, an apparatus provided with an addition nozzle inside liquid near the mother liquor inlet of the stirrer is preferred. This apparatus is described in Japanese Patent O.P.I. Publication No. 160126/1987. A rotating speed of 400 to 1,200 rpm is preferred at stirring.

In a light-sensitive material of the invention, regular crystals are used together with the foregoing twinned crystal grains.

Preferable examples of the regular crystal grains having no twins include a cube, octahedron, tetradecahedron, and a spherical grain. In these regular crystals excluding spherical ones, face rates of the (100) face and the (111) face may be arbitrary.

The face rate of silver halide grains can be measured by the X-ray diffraction method described below.

Using Cu as a target and K α ray of Cu as a radiation source, when diffraction patterns of the (100) face, (110) face and (111) face of a silver halide are determined at a tube current of 10 mA, a diffraction peak (A) of the (100) face appears in a range of 29 to 33 degree of angle of diffraction (2θ), and a diffraction peak (B) corresponding to the (110) face appears in a range of 43 to 47 degree of angle of diffraction (2θ).

Based on each of the diffraction peak intensities, any of the face rates can be calculated by the following equation.

(Example) Calculation of (100) face rate

-continued $$(100)\text{ face rate }(\%) = \frac{\frac{A}{1}}{\frac{A}{1} + \frac{B}{0.55} + \frac{C}{0.16}} \times 100$$

1: probability of occurring (100) face of silver bromide 0.55: probability of occurring (111) face of silver bromide 0.16: probability of occurring (110) face of silver bromide The (110) face ratio and the (111) face ration can also be determined in the same manner.

In the above regular crystal emulsion, one having a (111) face rate of 20% or more is preferred, one having that of 70% or more is particularly preferred.

The foregoing spherical silver halide grains can be prepared, as disclosed in Japanese Patent O.P.I. Publication Nos. 182730/1982, 179344/1984, 178447/1984, by performing ripening in the presence of a silver halide solvent after completing formation of silver halide grains.

The term spherical used here means that when a face having the largest area among polygons making the external shape of a grain is selected and the longest side of said polygon is denoted by l, edges of polygons left unsphered have a roundness with a radius of curvature corresponding to 1/6 l to 1/2 l.

The roundness of a grain can be determined by an electron microscopic observation of a silver halide grain.

It is preferred that the regular crystals of the invention are grains of core/shell type.

The core/shell type grains consist of silver halide grains of layered structure which comprise two or more phases different in silver iodide content, and silver iodobromide grains whose inner core have a higher silver iodide content than their outer shell is preferred.

The silver iodide content in the core is desirably 6 mol % or more, more desirably 8 mol % or more, most desirably 10 mol % or more. The silver iodide content in the shell is desirably 6 mol % or less, more desirably 0 to 4.0 mol %.

The volume of the shell portion in a core/shell type silver halide grain is desirably 10 to 80% of the total grain volume, more desirably 15 to 70%.

Further, the volume of the core portion amounts to desirably 10 to 80% of the total volume, more desirably 20 to 50%.

In the invention, when core/shell type grains consist of silver iodobromide, the difference in silver iodide content between a core portion and a shell portion may form a sharp boundary or change continuously without forming a clear boundary, but one which forms a sharp boundary is preferred. Multi-layered structure is also useful, and a core/shell structure comprising an intermediate shell having a silver iodide content intermediate between the core portion and the shell portion is also preferred.

In case of core/shell type silver halide grains having the above intermediate shell, the volume of the intermediate shell is desirably 5 to 60% of the total grain volume, more desirably 20 to 55%.

The differences in silver iodide content between the outer shell and the intermediate shell, and between the intermediate shell and the inner core are preferably 3 mol % or more, respectively. The difference in silver iodide content between the outer shell and the inner core is preferably 6 mol % or more.

In a regular crystalline core/shell type silver halide emulsion usable in the invention, the average silver iodide content is desirably 4 to 20 mol %, more desirably 5 to 15 mol %. Further, silver chloride may be contained within the limits not to impair the effect of the invention.

A core/shell type emulsion usable in the invention can be prepared by known methods disclosed in Japanese Patent O.P.I. Publication Nos. 177535/1984, 138538/1985, 52238/1984, 143331/1985, 35726/1985 and 258536/1985. As the method described in Examples of the above Japanese Patent O.P.I. Publication No. 138538/1985, it is preferred to grow a core/shell type silver halide emulsion starting with seed grains. In this case, a grain may have, at the center, a region where the silver halide composition is different from that of the core. In such a case, the silver halide composition of the seed grains may be any of silver bromide, silver iodobromide, silver chloroiodobromide, silver chlorobromide and silver chloride. But silver iodobromide or silver bromide containing 10 mol % or less of silver iodide is preferred.

The volume of seed grains in the total volume of silver halide is desirably 50% or less, more desirably 10% or less.

In preparing the above core/shell type silver halide grains, there is favorably used a method in which halogen conversion is performed using iodides primarily at a timing after or before the formation of a core or an intermediate shell.

The distribution of silver iodide in the above core/shell type silver halide grains can be detected by various physical measuring methods. For example, measurement of luminescence at a low temperature or the x-ray diffraction method described in the Summary of Reports Released in 1981 Annual Conference of the Society of Photographic Science and Technology of Japan.

Conventional silver halide solvents such as ammonia, thioether or thiourea may exist in the system while the above core/shell type silver halide grains are being grown.

In a process of forming nucleus grains and/or growing grains, there may be added a cadmium salt, zinc salt, lead salt, thallium salt, iridium salt (including complex salt), rhodium salt (including complex salt) and iron salt (including complex salt) to grow these metallic elements on the surface or inside of the above core/shell type silver halide grains. Further, reduction sensitized nuclei may be provided inside of the grain and/or on the surface of the grains by keeping them in a reducing atmosphere.

The above core/shell type silver halide grains may be subjected to removal of excessive soluble salts after completing growth of the grains, or left undesalted. The removal of salts can be carried out according to a method described in Section II of Research Disclosure No. 17643.

The above core/shell type silver halide grains may be those in which latent images are mainly formed on the surface or ones in which latent images are mainly formed inside thereof.

The size of the above core/shell type silver halide grains is normally 0.1 to 10 μm, desirably 0.2 to 5 μm, and more desirably 0.3 to 2 μm.

The above core/shell type silver halide grains can be used, no matter what grain size distribution they may have. Either a polydispersed emulsion of a wide grain size distribution or a monodispersed emulsion of a narrow grain size distribution may be used. Also, a polydispersed emulsion and a monodispersed emulsion may be mixed and used; but, it is preferred to use monodispersed emulsions singly or in combination of two or more. The term "monodispersed emulsion" used with respect to the emulsion comprising regular crystals is synonymous with the above.

Silver halide grains usable in a light-sensitive material of the invention can be chemically sensitized by a conventional method, or spectrally sensitized to a desired wavelength with a sensitizing dye.

To the silver halide emulsion, an antifogging agent, a stabilizer, etc. may be added. As a binder for said emulsion, gelatin is advantageously used.

In the invention, it is desirable to provide on a support two or more light-sensitive layers different in color sensitivity, incorporate an emulsion comprising the twinned crystal grains of the invention into at least one of the light-sensitive layers, and incorporate an emulsion comprising regular crystals into at least one of the remaining light-sensitive layers.

In a more desirable embodiment of the invention, at least one of light-sensitive layers in a silver halide color photographic material consists of two or more layers which are the same in color sensitivity and different in sensitivity, at least one of said two or more layers contains an emulsion comprising twinned crystal grains of the invention, and at least one of other layers contains an emulsion comprising regular crystals.

In the most desirable embodiment of the invention, two or more light-sensitive layers different in color sensitivity are provided on a support, at least one of said light-sensitive layers consists of two or more layers which are the same in color sensitivity and different in sensitivity, at least one of the highest sensitive layers thereof contains an emulsion comprising twinned crystal grains of the invention, and at least one of the lowest sensitive layers contains an emulsion comprising regular crystals.

The silver halide emulsion used in the light-sensitive material of the invention can be chemically sensitized by a conventional method and spectrally sensitized to a desired wavelength region with a sensitizing dye.

The silver halide emulsion may contain an antifogging agent, a stabilizer, etc. As a binder of the emulsion, gelatin is advantageously used.

Emulsion layers and other hydrophilic colloidal layers can be hardened, and may contain a plasticizer and a latex of a water-insoluble or scarcely soluble synthetic polymer.

The present invention is preferably used in an X-ray film and a color light-sensitive material such as a color negative or color reversal. Particularly, the invention is preferably used in a color reversal light-sensitive material which comprises at least one layer each of blue-sensitive, green-sensitive and red-sensitive layers.

When the invention is used in a color reversal light-sensitive material, a red-sensitive layer, green-sensitive layer and blue-sensitive layer are preferably provided in this order on a support, and an emulsion containing silver halide twinned crystal grains of the invention is used in the blue-sensitive layer. When the blue-sensitive layer consists of two or more layers different in sensitivity, the emulsion is added to the farthest one of these layers from the support. That is, it is preferred that said layer is the blue-sensitive layer of the highest sensitivity and that silver halide twinned crystal grains of the invention are added to the said high sensitive blue-sensitive layer.

In case that an emulsion comprising silver halide twinned crystal grains of the invention is used in a blue-sensitive layer, it is preferred that the blue-sensitive layer is spectrally sensitized with a known blue-sensitizing dye.

A known yellow coupler is preferably contained in said layer, a 2-equivalent yellow coupler is particularly preferred.

It is preferred to provide one or more of nonlight-sensitive layer on a side farther from the support than the layer to which an emulsion comprising silver halide twin grains of the invention is added.

In an emulsion layer of a color photographic light-sensitive material, couplers are incorporated.

Further, there may be used a colored coupler having a function of correction, a competitive coupler and compounds capable of releasing, upon coupling with an oxidation product of a developing agent, fragments useful in photography such as a developing accelerator, bleaching accelerator, developer, silver halide solvent, color-adjusting agent, hardener, fogging agent, antifogging agent, chemical sensitizer, spectral sensitizer and desensitizer.

In the light-sensitive material, auxiliary layers such as a filter layer, antihalation layer and anti-irradiation layer may be provided. These layers may contain a dye which is washed away from the light-sensitive material or bleached in a developing process.

There may be contained in the light-sensitive material a formalin scavenger, fluorescent whitening agent, matting agent, slipping agent, image stabilizer, surfactant, antistain agent, developing accelerator, developing inhibitor and bleaching accelerator.

Examples of the usable support include a paper laminated with polyethylene, polyethylene terephthalate film, baryta paper and a triacetyl cellulose film.

In forming color images on a light-sensitive material of the invention, a conventional color photographic process can be carried out after exposure.

EXAMPLES

The present invention will be described in more detail with the examples.

EXAMPLE 1

Preparation of Spherical Seed Grain Emulsion

The monodispersed spherical seed grain emulsion (Em-7) was prepared according to the method described in Japanese Patent O.P.I. Publication No. 6643/1986.

| Preparation of seed emulsion | | |
|---|---|---|
| $A_1$ | Ossein gelatin | 150 g |
| | Potassium bromide | 53.1 g |
| | Potassium iodide | 24 g |
| | Water to make | 7.2 l |
| $B_1$ | Silver nitrate | 1.5 kg |
| | Water to make | 6 l |
| $C_1$ | Potassium bromide | 1327 g |
| | 1-phenyl-5-mercaptotetrazole (dissolved in methanol) | 0.3 g |
| | Water to make | 3 l |
| $D_1$ | Aqueous ammonia (28%) | 705 ml |

While stirring the solution $A_1$ vigorously at 40° C., the solutions $B_1$ and $C_1$ were added thereto by the double-jet method in 30 seconds to form nuclei. The pBr during the addition was 1.09 to 1.15. 1 minute and 30 seconds after the addition, the solution $D_1$ was added in 20 seconds, and ripening was performed for 5 minutes at a KBr concentration of 0.071 mol/l and an ammonia concentration of 0.63 mol/l.

Then, pH was adjusted at 6.0, and desalination and subsequent washing were performed immediately after that. By electron microscopic observation as shown in FIG. 1, the resultant seed emulsion proved to be monodispersed spherical twinned crystal grains having an average grain size of 0.36 μm and a distribution extent of 18%.

EXAMPLE 2

The comparative emulsion Em-A having an average silver iodide content of 1.93 mol % was prepared using the seed emulsion of Example 1.

| Preparation of Em-A | | |
|---|---|---|
| $A_2$ | Ossein gelatin | 74.1 g |
| | Disodium propyleneoxy-polyethyleneoxy-disuccinate (10% methanol solution) | 10 m |
| | Seed emulsion of Example 1 equivalent to 0.883 mol | |
| | Water to make | 4 l |
| $B_2$ | Ossein gelatin | 98.1 g |
| | Potassium bromide | 724 g |
| | Potassium iodide | 20.8 g |
| | Water to make | 4 l |
| $C_2$ | Silver nitrate | 1049 g |
| | Water to make | 5611 ml |

While stirring the solution A vigorously at 65° C., the solutions $B_2$ and $C_2$ were added thereto by the double-jet method over a period of 40.5 minutes. During the addition, pH was maintained at 2.0 with nitric acid and pAg was kept at 9.0. Each of the addition speeds of $B_2$ and $C_2$ were linearly increased so as to make the speed at the end of addition 2.95 times as large as that of the start. After completion of the addition, pH was adjusted to 6.0, and then flocculating desalination was performed by adding an aqueous solution of Demol (made by Kao Atlas Co.) and an aqueous solution of magnesium sulfate for removing excessive salts. Thus, an emulsion of pAg 8.5 and pH 5.85 at 40° C. was obtained. An electron microscopic observation showed that the emulsion comprised tabular silver halide grains having an average grain size of 0.92 μm, a distribution extent of 14%, and that 88% of the projection area was held by (111) faces.

Figure 3:
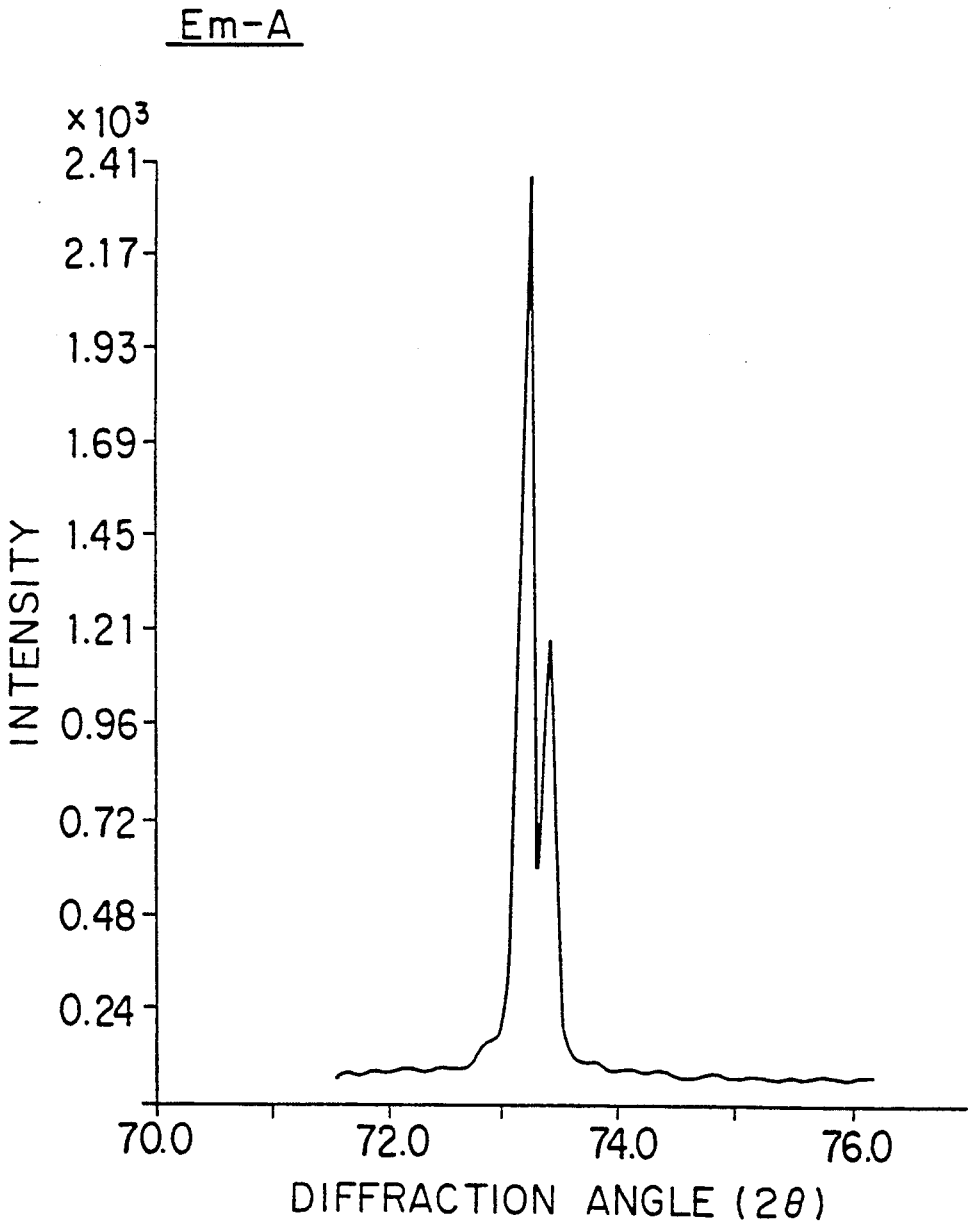
FIGS. 3, 4 and 5 are graphs showing X-ray diffraction signals of silver halide emulsion grains, respectively.

Further, these tabular silver halide grains had an average grain-diameter-to-grain-thickness ratio of 3.6. A Cu Kα X ray diffraction of the emulsion gave two sharp peaks at a peak interval of 0.27 degree (2θ), as shown in FIG. 3.

Figure 6:
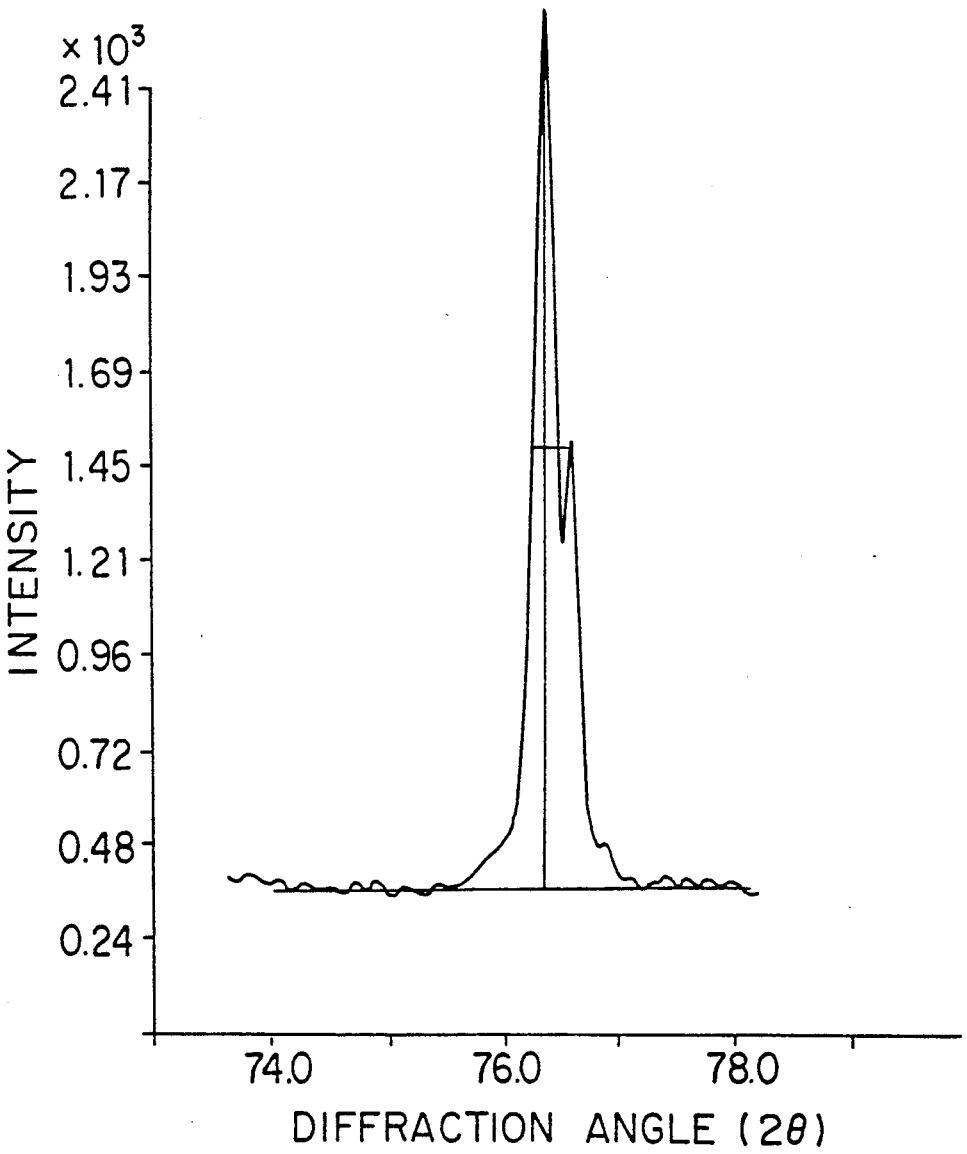
FIG. 6 is a (331) X-ray diffraction pattern of silicone powder.

In evaluating all the emulsion samples of the examples, Model JDX-11 made by JEOL, Ltd. was used as the measuring equipment, and measurement was performed using a graphite monochrometer as a monochrometer for diffracted rays under conditions of tube voltage 40 kV, tube current 50 mA and value width of a step angle 0.02 degree (2θ). The half (331) diffraction signal of silicon powder used as a standard sample was 0.33 degree (2θ) under the above measuring conditions, as shown in FIG. 6.

EXAMPLE 3

The comparative monodispersed twinned crystal grain emulsion Em-B was prepared using the seed emulsion in Example 1. The resultant emulsion had the same average grain volume as Em-A, an average silver iodide content of 8.0 mol %, and high silver iodide content phases inside of the grains.

| | | |
|---|---|---|
| $A_3$ | Ossein gelatin | 65 g |
| | Disodium propyleneoxy-polyethyleneoxy-disuccinate (10% methanol solution) | 10 ml |
| | Seed emulsion of Example 1 equivalent to 0.883 mol | |
| | Water to make | 4 l |
| $B_{3-1}$ | Ossein gelatin | 119 g |
| | Potassium bromide | 136.3 g |
| | Potassium iodide | 81.5 g |
| | Water to make | 2976 ml |
| $C_{3-1}$ | Silver nitrate | 284 g |
| | Nitric acid (1.38) | 1.5 ml |
| | Water to make | 2976 ml |
| $B_{3-2}$ | Ossein gelatin | 51.5 g |
| | Potassium bromide | 530 g |
| | Potassium iodide | 7.5 g |
| | Water to make | 1287 ml |
| $C_{3-2}$ | Silver nitrate | 766 g |
| | Nitric acid (1.38) | 5.4 ml |
| | Water to make | 1287 ml |

While stirring the solution $A_3$ vigorously at 75° C. the solutions $B_{3-1}$ and $C_{3-1}$ were added by the double-jet method. In the course of addition, pH was kept at 2.0 with nitric acid and pAg was kept at 8.0. The addition time was 45 minutes, the addition speed was linearly increased so as to be 1.9 times that of the start at the end of the addition. Next, the solutions $B_{3-2}$ and $C_{3-2}$ were added thereto by the double-jet method while keeping pH at 2.0 and pAg at 8.0. The addition time was 28 minutes, the addition speed was linearly increased so as to be 1.75 times that of the start at the end of addition. After completing the addition, pH was adjusted to 6.0 and then flocculating desalination was carried out to remove excessive salts by adding an aqueous solution of Demol and an aqueous solution of magnesium sulfate. Thus, an emulsion of pAg 8.5 at 40° C. was prepared.

The emulsion prepared as above was observed with an electron microscope and found to be a monodispersed tabular silver halide emulsion comprising (100) faces and (111) faces and having an average grain size of 0.75 μm and a distribution extent of 15%.

Figure 4:
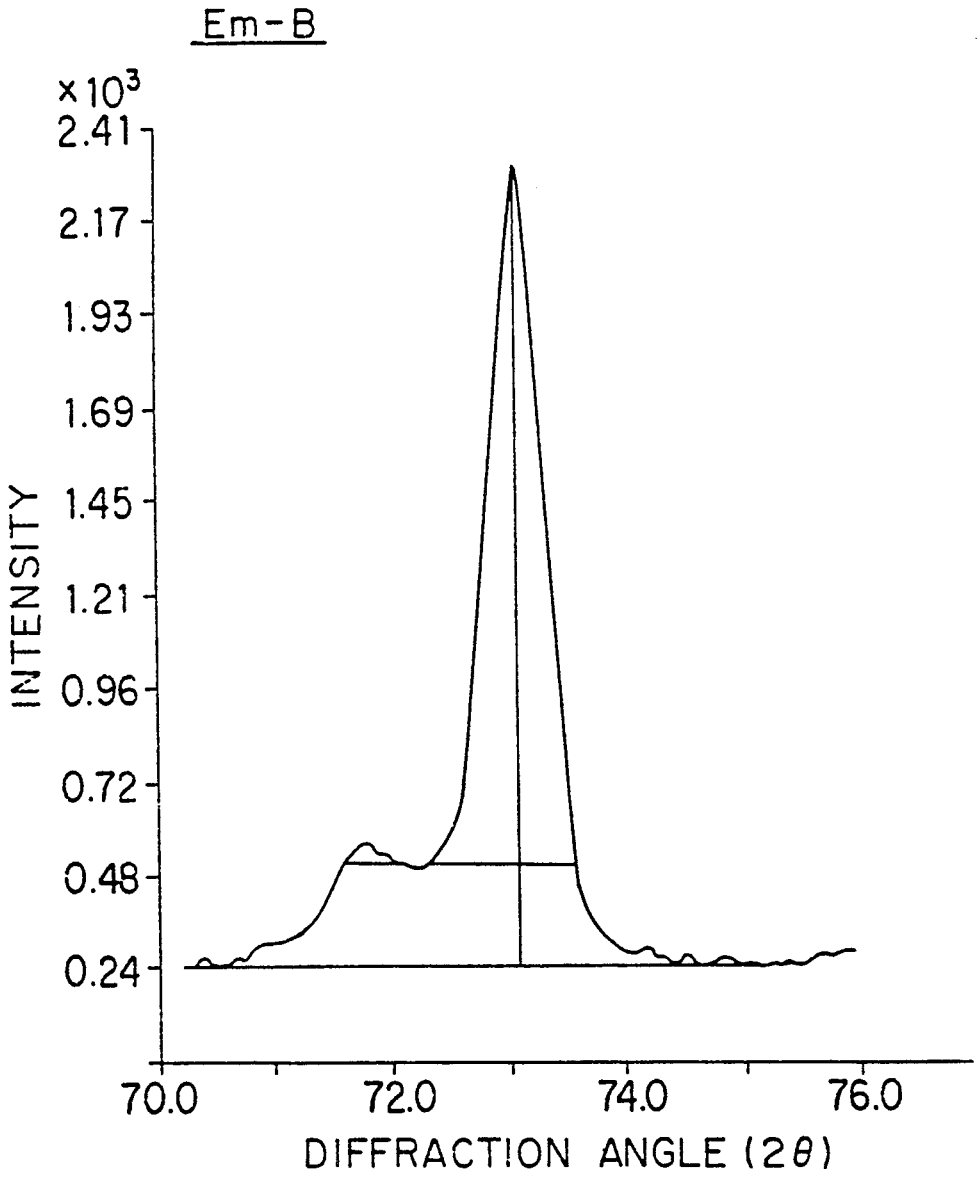

A (420) diffraction pattern of this emulsion, as shown in FIG. 4, was a wide signal having two peaks at a peak interval of 1.32 degree, when a Cu Kα ray was used as a radiation source.

EXAMPLE 4

Using the seed emulsion in Example 1, there was prepared the emulsion Em-1 whose average grain volume was the same as Em-A or Em-B and average silver iodide content was 2.25 mol %.

| Preparation of Em-1 | | |
|---|---|---|
| $A_4$ | Ossein gelatin | 85 g |
| | Disodium propyleneoxy-polyethyleneoxy-disuccinate (10% methanol solution) | 10 ml |
| | Seed emulsion of Example 1 equivalent to 0.98 mol | |
| | Water to make | 4 l |
| $B_{4-1}$ | Ossein gelatin | 43.3 g |
| | Potassium bromide | 36.1 g |

-continued

| Preparation of Em-1 | | |
|---|---|---|
| | Potassium iodide | 21.6 g |
| | Water to make | 1082 ml |
| $C_{4-1}$ | Silver nitrate | 73.5 g |
| | Nitric acid (1.38) | 5.5 ml |
| | Water to make | 1082 ml |
| $B_{4-2}$ | Ossein gelatin | 44.2 g |
| | Potassium bromide | 682 g |
| | Potassium iodide | 2.86 g |
| | Water to make | 2210 ml |
| $C_{4-2}$ | Silver nitrate | 977 g |
| | Nitric acid (1.38) | 9.3 ml |
| | Water to make | 2210 ml |

While stirring the solution A4 vigorously at 75° C., the solutions $B_{4-1}$ and $C_{4-1}$ were added thereto by the double-jet method. In the course of the addition, pH was maintained at 2.0 with nitric acid and pAg was maintained at 8.0. The addition time was 16 minutes, the addition speed was linearly increased in order that it reached 1.27 times as large as that of start at the end of addition. The remainder of the preparation was the same as in Example 3, except that $B_{4-2}$ and $C_{4-2}$ were substituted for $B_{3-2}$ and $C_{3-2}$, respectively. After completion of the addition, flocculating desalination was performed in the same manner as in Comparisons 1 and 2. Thus, an emulsion of pAg 8.5 and pH 5.85 at 40° C. was obtained.

Figure 2:
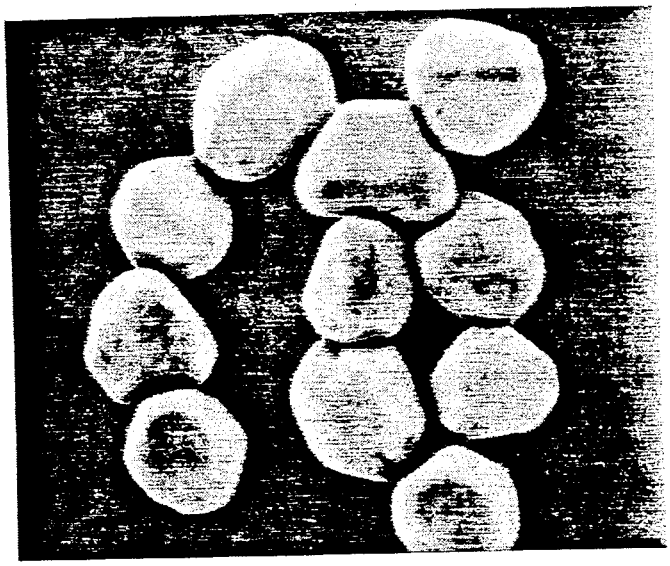
FIG. 2 is that of an emulsion grain of Example 4 (25,000X magnification).

By an electron microscopic observation as shown in FIG. 2, it was found that the resultant silver halide emulsion consisted entirely of twinned crystal grains and had an average grain size of 0.73 μm and a distribution extent of 11%. Further, 100% of the projection area had a grain-diameter-to-grain-thickness ration of 1.0 to 1.5 and comprised of (100) faces and (111) faces at a ratio of 64:36.

Figure 5:
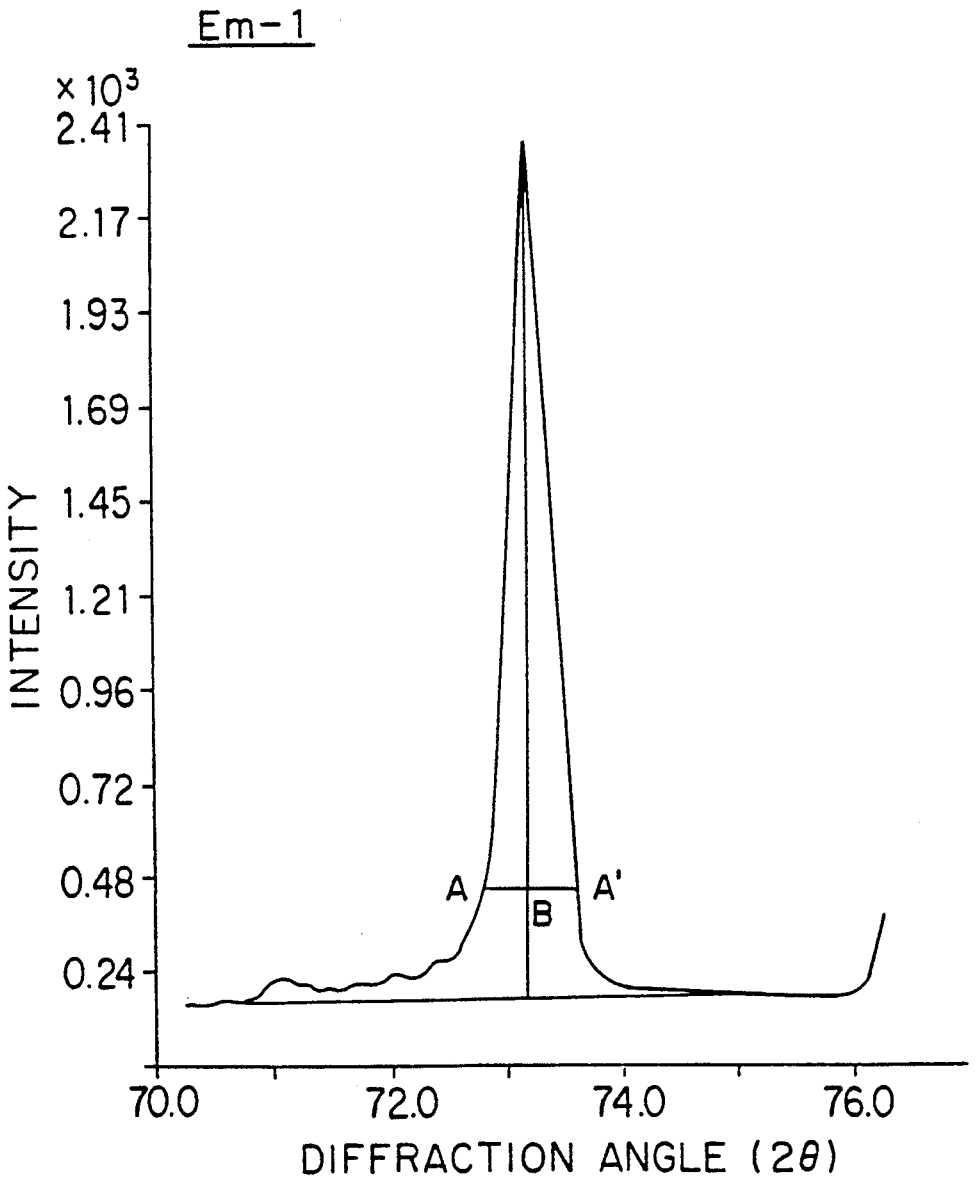

In a diffractiometry using a Cu Kα ray as a radiation source as shown in FIG. 5, a (420) diffracted signal of this emulsion had a single peak, and a diffraction width at the maximum peak height times 0.13 was 0.816 degree (2 ). Moreover, when an intersecting point made by a vertical line drawn downward from the maximum peak and a horizontal line drawn at a height of the peak height times 0.13 was denoted by B, and a line segment cut from the above horizontal line by the signal was denoted by AA', AA' was parted by B into an AB:BA' ratio of 0.85:1.

EXAMPLE 5

The emulsion Em-2 of the invention having an average silver iodide content of 2.02 mol % was prepared in the same manner as in Example 4, except that the $B_{4-2}$ solution of Example 2 was replaced with the following solution $B_{5-2}$.

| Preparation of Em-2 | | |
|---|---|---|
| $B_{5-2}$ | Ossein gelatin | 44.2 g |
| | Potassium bromide | 684 g |
| | Water to make | 2210 ml |
| $A_5$ | The same as the solution A1 in Example 4 | |
| $B_{5-1}$ | The same as the solution $B_{4-1}$ in Example 4 | |
| $C_{5-1}$ | The same as the solution $C_{4-1}$ in Example 4 | |
| $C_{5-2}$ | The same as the solution $C_{4-2}$ in Example 4 | |

By an electron microscopic observation, it was found that the emulsion consisted entirely of silver halide twinned crystal grains having an average grain size of 0.73 μm in diameter and a distribution extent of 11%. In addition, 100% of the projection area had a grain-diameter-to-grain-thickness of 1.0 to 1.5 and comprised of (100) faces and (111) faces at a ratio of 65:35.

A (420) diffraction pattern of this emulsion, when a Cu Kα ray was used as a radiation source, had a single peak, and a diffracted width at the maximum peak height times 0.13 was 0.820 degree (2θ). Moreover, when an intersecting point made by a vertical line drawn downward from the maximum peak and a horizontal line drawn at the peak height times 0.13 was denoted by B, and a line segment cut from the above horizontal line by the signal was denoted by AA', AA' was parted by B into an AB:BA' ratio of 0.86:1.

EXAMPLE 6

Preparation of Regular Crystal Emulsions Em-3, 4, 5 and 6

There was prepared) by referring to the method of Japanese Patent O.P.I. Publication No. 178447/1084, the monodispersed core/shell emulsion Em-3 which had silver iodide contents of 30 mol%, 0.1 mol% and 5.0 mol% in the core, in the shell and as an average, respectively, and an average grain size of 0.27 μm in diameter; and consisted of tetradecahedral grains having a distribution extent of 12%.

In the same manner, the monodispersed core/shell emulsion Em-4 was prepared. The emulsion had silver iodide contents of 12 mol%, 0.1 mol% and 2.5 mol% in the core, in the shell and as an average, respectively, and an average grain size of 0.27 μm; and consisted of tetradecahedral grains having a distribution extent of 12%.

The emulsion Em-5 was prepared in the same manner. The emulsion was the same as Em-3 except that it had an average grain size of 0.65 μm. Further, there was prepared likewise the monodispersed core/shell emulsion Em-6 having silver iodide contents of 40 mol%, 0.5 mol% and 8.0 mol% in the core, in the shell and as an average, respectively, and an average grain size of 0.65 μm; and consisted of tetradecahedral grains having a distribution extent of 12%.

Sensitization of Each Emulsion

Each of the above silver halide emulsions Em-A, Em-B, Em-1, Em-2, Em-3, Em-4, Em-5, Em-6 and Em-7 was subjected to chemical ripening at 50° C. with the addition of proper amounts of sodium thiosulfate, chloroauric acid and ammonium thiocyanate. After the chemical ripening, 4-hydroxy-6-methyl-1,3,3a,7-tetrazaindene was added thereto as a sensitizing dye and stabilizer.

Using these emulsions, the following multi-layered color light-sensitive materials were prepared.

EXAMPLE 7

On a subbed triacethyl cellulose film support were coated the following layers in order to prepare the multi-layered color light-sensitive material sample 1 (comparison sample). The coating weight of each component is shown in g/m$^2$, but that of silver halide is in terms of silver, and that of a coupler is the number of mols per mol of silver.

| 1st layer (antihalation layer) | |
|---|---|
| Ultraviolet absorbent (U-1) | 0.3 |
| Ultraviolet absorbent (U-2) | 0.4 |
| High boiling solvent (O-1) | 1.0 |

-continued

| | |
|---|---|
| Black colloidal silver | 0.24 |
| Gelatin | 2.0 |
| 2nd layer (intermediate layer) | |
| 2,5-di-t-octylhydroquinone | 0.1 |
| High boiling solvent (O-1) | 0.2 |
| Gelatin | 1.0 |
| 3rd layer (low speed red-sensitive silver halide emulsion layer) | |
| AgBrI spectrally sensitized by red-sensitizing dyes (S-1 and S-2) (AgI: 4.0 mol %, average grain size: 0.25 μm) | 0.5 |
| Coupler (C-1) | 0.1 mol |
| High boiling solvent (O-2) | 0.6 |
| Gelatin | 1.3 |
| 4th layer (high speed red-sensitive silver halide emulsion layer) | |
| AgBrI spectrally sensitized by red-sensitizing dyes (S-1 and S-2) (Em-A) | 0.8 |
| Coupler (C-1) | 0.2 |
| High boiling solvent (O-2) | 1.2 |
| Gelatin | 1.8 |
| 5th layer (intermediate layer) | |
| 2,5-di-t-octhylhydroquinone | 0.1 |
| High boiling solvent | 0.2 |
| Gelatin | 0.9 |
| 6th layer (low speed green-sensitive silver halide emulsion layer) | |
| AgBrI spectrally sensitized by green-sensitizing dyes (S-3 and S-4) (AgI: 4 mol %, average grain size: 0.25 μm) | 0.6 |
| Coupler (M-1) | 0.04 mol |
| Coupler (M-2) | 0.01 mol |
| High boiling solvent (O-3) | 0.5 |
| Gelatin | 1.4 |
| 7th layer (high speed green-sensitive silver halide emulsion layer) | |
| AgBrI spectrally sensitized by green-sensitizing dyes (S-3 and S-4) (Em-A) | 0.9 |
| Coupler (M-1) | 0.10 mol |
| Coupler (M-2) | 0.02 mol |
| High boiling solvent (O-3) | 1.0 |
| Gelatin | 1.5 |

-continued

| | |
|---|---|
| 8th layer (intermediate layer) | |
| The same as 5th layer | |
| 9th layer (yellow filter layer) | |
| Yellow colloidal silver | 0.1 |
| Gelatin | 0.9 |
| 2,5-di-t-octylhydroquinone | 0.1 |
| High boiling solvent (O-1) | 0.2 |
| 10th layer (low speed blue-sensitive silver halide emulsion layer) | |
| AgBrI spectrally sensitized by blue-sensitizing dye (S-5) (AgI: 2.5 mol %, average grain size: 0.35 μm) | 0.6 |
| Coupler (Y-1) | 0.3 mol |
| High boiling solvent | 0.6 |
| Gelatin | 1.3 |
| 11th layer (high speed blue-sensitive silver halide emulsion layer) | |
| AgBrI spectrally sensitized by blue-sensitizing dye (S-5) (AgI: 2 mol %, average grain size: 0.9 μm) | 0.9 |
| Coupler (Y-1) | 0.5 mol |
| High boiling solvent (O-3) | 1.4 |
| Gelatin | 2.1 |
| 12th layer (1st protective layer) | |
| Ultraviolet absorbent (U-1) | 0.3 |
| Ultraviolet absorbent (U-2) | 0.4 |
| 2,5-di-t octylhydroquinone | 0.1 |
| High boiling solvent (O-1) | 0.6 |
| Gelatin | 1.2 |
| 13th layer (2nd protective layer) | |
| Nonlight-sensitive fine grain silver halide emulsion consisting of silver iodobromide having an average grain size of 0.08 μm and containing 1 mol % of silver iodide as converted into silver | 0.3 |
| Polymethylmethacrylate particles (diameter: 1.5 μm) | 0.6 |
| Surfactant (SA-1) | 0.004 |
| Gelatin | 0.7 |

In each of the above layers, a gelatin hardener (H-1) and a surfactant were added in addition to the above compounds.

Ultraviolet absorbent U-1

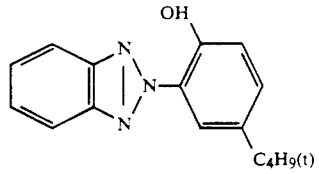

Ultraviolet absorbent U-2

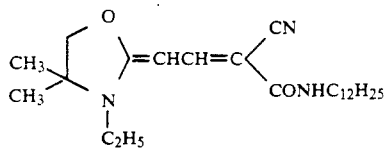

Sensitizing dye S-1

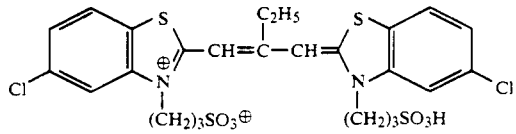

-continued
Sensitizing dye S-2
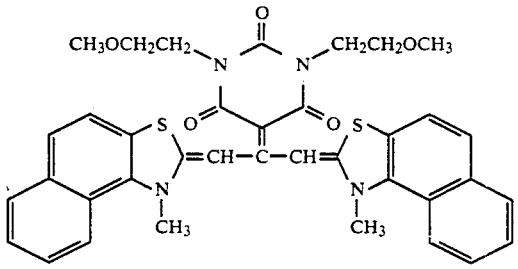
Sensitizing dye S-3
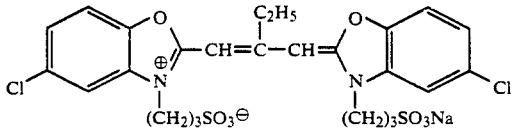
Sensitizing dye S-4
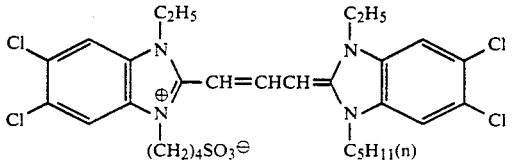
Sensitizing dye S-5
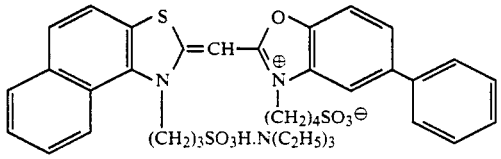
Coupler C-1
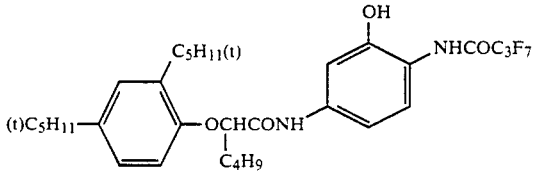
Coupler M-1
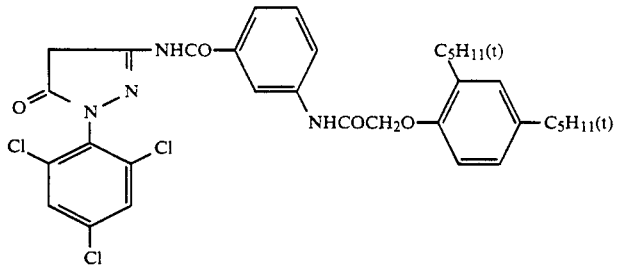
Coupler M-2
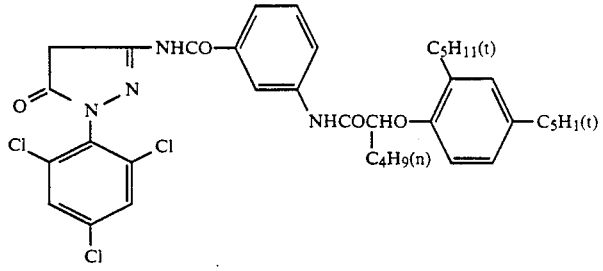

-continued

Coupler Y-1

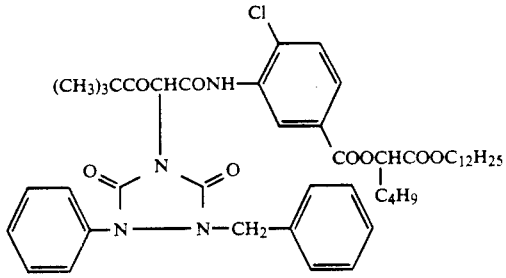

Gelatin hardener H-1

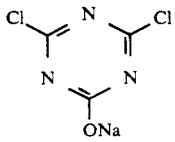

Surfactant SA-1

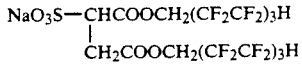

O-1

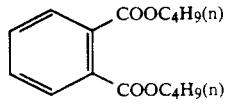

O-2

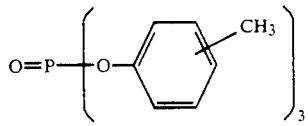

O-3

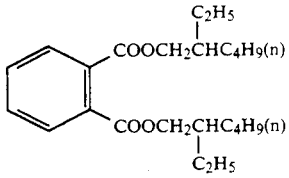

Next, in contrast to the comparative sample, the samples 2 through 4 shown in Table 1 were prepared.

The samples so prepared were exposed to green light via an optical wedge (CC 90G filter made by Eastman Kodak Co.) and then developed in the following procedure.

TABLE 1

| Sample No. | 4th layer | 7th layer |
|---|---|---|
| 1 | Em-A | Em-A |
| 2 | Em-B | Em-B |
| 3 | Em-1 | Em-1 |
| 4 | Em-2 | Em-2 |

| Processing step | Time | Processing Temp. |
|---|---|---|
| 1st developing | 6 minutes | 38° C. |
| Washing | 2 minutes | 38° C. |
| Reversing | 2 minutes | 38° C. |
| Color developing | 6 minutes | 38° C. |
| Conditioning | 2 minutes | 38° C. |
| Bleaching | 6 minutes | 38° C. |
| Fixing | 4 minutes | 38° C. |
| Washing | 4 minutes | 38° C. |
| Stabilizing | 1 minute | normal temperature |
| Drying | | |

Processing solutions of the following compositions were used in the above processes.

| | |
|---|---|
| 1st developing solution | |
| Sodium tetrapolyphosphate | 2 g |
| Sodium sulfite | 20 g |
| Hydroquinone monosulfonate | 30 g |
| Sodium carbonate (monohydrate) | 30 g |
| 1-phenyl-4-methyl-4-hydroxymethyl-3-pyrazolidone | 2 g |
| Potassium bromide | 2.5 g |
| Potassium thiocyanate | 1.2 g |
| Potassium iodide (0.1% solution) | 2 ml |
| Water to make | 1000 ml |
| Reversing solution | |
| Hexasodium nitrilotrimethylene phosphonate | 3 g |
| Stannous chloride (dihydrate) | 1 g |
| p-aminophenol | 0.1 g |
| Sodium hydroxide | 8 g |
| Glacial acetic acid | 15 ml |
| Water to make | 1000 ml |
| Color developing solution | |
| Sodium tetrapolyphosphate | 3 g |
| Sodium sulfite | 7 g |
| Sodium tertiary phosphate (dihydrate) | 36 g |
| Potassium bromide | 1 g |
| Potassium iodide (0.1% solution) | 90 ml |
| Sodium hydroxide | 3 g |
| Citrazinic acid | 1.5 g |
| N-ethyl-N-β-methanesulfonamidethyl-3-methyl-4-aminoaniline sulfate | 11 g |
| 2,2-ethylene dithioethanol | 1 g |
| Water to make | 1000 ml |

-continued

| | |
|---|---|
| Conditioning solution | |
| Sodium sulfite | 12 g |
| Sodium ethylenediamine tetracetate (dihydrate) | 8 g |
| Thioglycerine | 0.4 ml |
| Glacial acetic acid | 3 ml |
| Water to make | 1000 ml |
| Bleaching solution | |
| Sodium ethylenediamine tetracetate (dihydrate) | 2 g |
| Ammonium ferric ethylenediamine tetracetate (dihydrate) | 120 g |
| Ammonium bromide | 100 g |
| Water to make | 1000 ml |
| Fixing solution | |
| Ammoniium thiosulfate | 80 g |
| Sodium sulfite | 5 g |
| Sodium bisulfite | 5 g |
| Water to make | 1000 ml |
| Stabilizing solution | |
| Formalin (37 wt %) | 5 ml |
| Koniducks (made by Konica Corp.) | 5 ml |
| Water to make | 1000 ml |

The densities of the developed samples were measured with a densitometer model 310 made by X-Rite Co. The results are shown in Table 2.

TABLE 2

| Experiment No. | Sample No. | Density of CC-90G-exposed sample Yellow | Magenta | Cyan | |
|---|---|---|---|---|---|
| 1 | 1 | 1.90 | 1.00 | 1.60 | Comparison |
| 2 | 2 | 2.00 | 1.00 | 1.70 | Comparison |
| 3 | 3 | 2.30 | 1.00 | 2.20 | Invention |
| 4 | 4 | 2.25 | 1.00 | 2.15 | Invention |

As seen in Table 2, the inventive samples have higher yellow and cyan densities than non-inventive ones when their magenta densities are 1.00, thereby they have proved to be excellent in green color reproduction.

EXAMPLE 8

The samples 1 through 4 prepared in Example 7 were exposed via an optical wedge with a CC fiter and a CC-90R filter (made by Eastmam Kodak Co.), then, subjected to development and sensitometry in the same manner as in Example 5. The results are shown in Table 3.

TABLE 3

| Experiment No. | Sample No. | Density of CC-90R-exposed sample Yellow | Magenta | Cyan | |
|---|---|---|---|---|---|
| 5 | 1 | 2.20 | 2.00 | 1.00 | Comparison |
| 6 | 2 | 2.25 | 2.05 | 1.00 | Comparison |
| 7 | 3 | 2.50 | 2.50 | 1.00 | Invention |
| 8 | 4 | 2.45 | 2.45 | 1.00 | Invention |

As seen in Table 3, the inventive samples have higher yellow and magenta densities when their cyan densities are 1.00, thereby it is apparent that they are excellent in green color reproduction.

EXAMPLE 9

On a subbed triacetylcellulose film, the layers of the following composition were coated in sequence to prepare the multi-layered color reversal light-sensitive material sample 5, as a comparative sample. The coating weight of each component is shown in g/m$^2$, but that of silver halide is in terms of silver.

| | |
|---|---|
| 1st layer (antihalation layer) | |
| Ultraviolet absorbent U-1 | 0.3 |
| Ultraviolet absorbent U-2 | 0.4 |
| High boiling solvent O-1 | 1.0 |
| Black colloidal silver | 0.24 |
| Gelatin | 2.0 |
| 2nd layer (intermediate layer) | |
| 2,5-di-t-octylhydroquinone | 0.1 |
| High boiling solvent O-1 | 0.2 |
| Gelatin | 1.0 |
| 3rd layer (low speed red-sensitive silver halide emulsion layer) | |
| AgBrI spectrally sensitized be red-sensitizing dyes (S-1 and S-2) (AgI: 4.0 mol %, average grain size: 0.25 μm) | 0.5 |
| Coupler C-1 | 0.3 |
| High boiling solvent O-2 | 0.6 |
| Gelatin | 1.3 |
| 4th layer (high speed red-sensitive silver halide emulsion layer) | |
| AgBrI spectrally sensitized by red-sensitizing dyes (S-1 and S-2) (AgI: 2.5 mol %, average grain size: 0.6 μm) | 0.8 |
| Coupler C-1 | 1.0 |
| High boiling solvent O-2 | 1.2 |
| Gelatin | 1.8 |
| 5th layer (intermediate layer) | |
| 2,5-di-t-octhylhydroquinone | 0.1 |
| High boiling solvent O-1 | 0.2 |
| Gelatin | 0.9 |
| 6th layer (low speed green sensitive silver halide emulsion layer) | |
| AgBrI spectrally sensitized by green-sensitizing dyes (S-3 and S-4) (Em-3) | 0.6 |
| Coupler M-1 | 0.15 |
| Coupler M-2 | 0.04 |
| High boiling solvent O-3 | 0.5 |
| Gelatin | 1.4 |
| 7th layer (high speed green-sensitive silver halide emulsion layer) | |
| AgBrI spectrally sensitized by green-sensitizing dyes (S-3 and S-4) (Em-A) | 0.9 |
| Coupler M-1 | 0.56 |
| Coupler M-2 | 0.12 |
| High boiling solvent O-3 | 1.0 |
| Gelatin | 1.5 |
| 8th layer (intermediate layer) | |
| The same as 5th layer | |
| 9th layer (yellow filter layer) | |
| Yellow colloidal silver | 0.1 |
| Gelatin | 0.9 |
| 2,5-di-t-octylhydroquinone | 0.1 |
| High boiling solvent O-1 | 0.2 |
| 10th layer (low speed blue-sensitive silver halide emulsion layer) | |
| AgBrI spectrally sensitized by a blue-sensitizing dye (S-5) (AgI: 2.5 mol %, average grain size: 0.35 μm) | 0.6 |
| Coupler Y-1 | 1.4 |
| High boiling solvent O-3 | 0.6 |
| Gelatin | 1.3 |
| 11th layer (high speed blue-sensitive silver halide emulsion layer) | |
| AgBrI spectrally sensitized by a blue-sensitizing dye (S-5) (AgI: 2.5 mol %, average grain size: 0.9 μm) | 0.9 |
| Coupler Y-1 | 3.5 |
| High boiling solvent (O-3) | 1.4 |
| Gelatin | 2.1 |
| 12th layer (1st protective layer) | |
| Ultraviolet absorbent U-1 | 0.3 |
| Ultraviolet absorbent U-2 | 0.4 |
| 2,5-di-t-octylhydroquinone | 0.1 |
| High boiling solvent O-3 | 0.6 |
| Gelatin | 1.2 |
| 13th layer (2nd protective layer) | |

-continued

| | |
|---|---|
| Non-light sensitive fine grain silver halide emulsion consisting of silver iodobromide having an average grain size (r) of 0.08 μm and containing 1 mol % of silver iodide as converted into silver | 0.3 |
| Polymethylmethacrylate particles (diameter: 1.5 μm) | 0.6 |
| Surfactant SA-1 | 0.004 |
| Gelatin | |

Besides the above compounds, a gelatin hardener H-1 and a surfactant were added in the above layers.

Next, the samples 6 through 14 were prepared by replacing the silver halide emulsions in the 6th and 7th layers of the sample 5 with emulsions shown in Table 4.

TABLE 4

| Sample No. | 6th layer | 7th layer |
|---|---|---|
| 5 | Em-3 | Em-A |
| 6 | Em-3 | Em-B |
| 7 | Em-3 | Em-5 |
| 8 | Em-4 | Em-5 |
| 9 | Em-3 | Em-6 |
| 10 | Em-3 | Em-1 |
| 11 | Em-4 | Em-1 |
| 12 | Em-3 | Em-2 |
| 13 | Em-7 | Em-1 |
| 14 | Em-7 | Em-2 |

After being subjected to forced deterioration at 40° C. and 80% RH for 7 days, the samples 5 through 14 were exposed to a white light via an optical wedge together with non-deteriorated samples and then developed in the same manner as in Example 7.

The densities of the developed samples were measured with a densitometer model 310 made by X-Rite Co. using a status A filter. From the measured results with a green light, increase in fog (this causes lowering of a maximum density because samples of this example are a reversal light-sensitive material) and sensitivities (the sensitivity of the sample 5 which was not subjected to forced deterioration was set at 100) were calculated. The results are shown in Table 5. The sensitivities were calculated at a point of density 1.8 in the measurement with a green light.

TABLE 5

| Sample No. | Sensitivity of non-treated sample | Forced deterioration treatment | |
|---|---|---|---|
| | | Maximum density drop | Sensitivity |
| 5 (Comparison) | 100 | 0.17 | 86 |
| 6 (Comparison) | 101 | 0.10 | 88 |
| 7 (Comparison) | 101 | 0.06 | 93 |
| 8 (Comparison) | 100 | 0.09 | 88 |
| 9 (Comparison) | 104 | 0.05 | 90 |
| 10 (Invention) | 102 | 0.03 | 96 |
| 11 (Invention) | 101 | 0.03 | 94 |
| 12 (Invention) | 102 | 0.04 | 97 |
| 13 (Comparison) | 100 | 0.05 | 90 |
| 14 (Comparison) | 102 | 0.05 | 91 |

It is understood in this example that storage stability is improved when an emulsion comprising twinned crystal grains of the invention is added to the high speed layer (7th layer), and an emulsion comprising regular crystals is added to the low speed layer (6th layer). When both of the high speed and low speed layers use emulsions of regular crystals, the preservability is deteriorated due to the influence of silver iodide content in the emulsion of the low speed layer. Though the sensitivity becomes higher owing to the high silver iodide content in the emulsion of the high speed layer, the storage stability is deteriorated.

EXAMPLE 10

The samples 15 through 24 were prepared by converting Em-A, B and Em 1 through 7 used in Example 9 into red-sensitive emulsions with the addition of a red-sensitizing dye, and using the 3rd and 4th layers which were the same as the sample 5 in Example 9. Then, the forced deterioration treatment and exposure were carried out as in Example 9, and then the densities of the samples were measured with a red light. The same effect as in Example 9 was observed.

EXAMPLE 11

The samples 25 through 34 were prepared by converting Em-A, B and Em 1 through 7 used in Example 9.into blue-sensitive emulsions with the addition of a blue-sensitizing dye, and changing the 10th and 11th layers of the sample 5 in Example 9 to the layers shown in Table 4 of Example 9. Subsequently, the forced deterioration treatment and exposure were carried out as in Example 9, and then the densities of the samples were measured with a blue light. The same effect as in Example 9 was observed.

EXAMPLE 12

The sample 35 was prepared as a comparative sample of multi-layered color light-sensitive material. In the reparation, the same layers as in the sample 5 of Example 9 were coated on a triacetylcellulose film support in the same sequence, except that Em-A was used.

Next, in contrast to the comparative sample 35, the samples 36 through 38 were prepared by replacing Em-A with emulsions shown in Table 6.

TABLE 6

| Sample No. | Emulsion used in 11th layer |
|---|---|
| 35 | Em-A |
| 36 | Em-B |
| 37 | Em-1 |
| 38 | Em-2 |

The following (1) scratch test and (2) bending test were carried out on each of the samples.

(1) The Scratch Test

A sample was fixed on a steel plate with the light-sensitive layer side up. Then, pressure was applied thereon with a diamond needle whose point having a diameter of 0.01 mm, by moving the needle on the sample under loads of 10 g, 20 g and 40 g at a speed of 1.0 cm/sec.

(2) The Bending Test

A sample was bent to a bent angle of 20 degree with a curvature of radius of 3 mm along the direction in which the exposure was varied, and then allowed to stand for 5 seconds. The test was performed on both of inward bending and outward bending with respect to the light-sensitive layer.

The samples 35 through 38 prepared as above were exposed using a white light through an optical wedge and developed in the same manner as in Example 5.

Each of the developed samples was subjected to densitometry using a densitometer model 310 made by X-Rite Co. to determine the relative sensitivity.

In the scratch test, the density difference ($\Delta D_{1.0}$) between a point where the pressure was applied and a un-pressurized point at a place of density 1.0 in a blue-light measurement was determined using a microdensitometer model PDM-5 made by Konica Corp. In the bending test, the difference in density between a bent point and an non-bent point was visually observed according to the following criterion.

a. no density difference is observed.
b. a slight density difference is observed.
c. a density difference is observed.
d. a large density difference is observed.

The evaluation results are shown in Table 7.

TABLE 7

| Sample No. | Relative sensitivity | Scratch test ($\Delta D_{1.0}$) 10 g | 20 g | 40 g | Bending test Inward bending | Outward bending |
|---|---|---|---|---|---|---|
| 35 (Comparison) | 100 | +0.04 | +0.06 | +0.09 | b | c |
| 36 (Comparison) | 114 | +0.08 | +0.10 | +0.16 | c | d |
| 37 (Invention) | 120 | +0.02 | +0.02 | +0.04 | a | b |
| 38 (Invention) | 118 | +0.02 | +0.03 | +0.05 | a | b |

As apparent from Table 7, the samples which use an emulsion comprising silver halide twin grains of the invention exhibit an excellent pressure stability with their high sensitivity unchanged.

EXAMPLE 13

The sample 40 was prepared as a comparative color reverse light-sensitive material, by providing the following 1st to 11th layers on a paper support coated with polyethylene on both sides. The coating weight of each component is shown in g/m$^2$, but that of silver halide is shown as a converted value into silver.

| | |
|---|---|
| 1st layer (antihalation layer) | |
| Black colloidal silver | 0.10 |
| Gelatin | 1.5 |
| 2nd layer (1st red-sensitive layer) | |
| Cyan coupler (C-1) | 0.14 |
| Cyan coupler (C-2) | 0.07 |
| Antifading agent (A-1) | 0.12 |
| Antifading agent (A-2) | 0.06 |
| High boiling solvent (O-1) | 0.18 |
| AgBrI spectrally sensitized by red-sensitizing dyes (S-1 and S-2) (AgI: 6.0 mol %, average grain size: 0.4 μm) | 0.14 |
| Gelatin | 0.81 |
| 3rd layer (2nd red-sensitive layer) | |
| Cyan coupler (C-1) | 0.043 |
| Cyan coupler (C-2) | 0.085 |
| Antifading agent (A-1) | 0.064 |
| Antifading agent (A-2) | 0.032 |
| High boiling solvent (O-1) | 0.097 |
| AgBrI spectrally sensitized by red-sensitizing dyes (S-1 and S-2) (AgI: 6.0 mol %, average grain size: 0.8 μm) | 0.16 |
| Gelatin | 0.98 |
| 4th layer (1st intermediate layer) | |
| Gelatin | 0.9 |
| Antistain agent (AN-1) | 0.02 |
| Antistain agent (AN-2) | 0.06 |

-continued

| | |
|---|---|
| High boiling solvent (O-2) | 0.13 |
| 5th layer (1st green-sensitive layer) | |
| Magenta coupler (C-3) | 0.25 |
| Antifading agent (A-3) | 0.067 |
| Antifading agent (A-4) | 0.12 |
| High boiling solvent (O-1) | 0.19 |
| AgBrI spectrally sensitized by a green-sensitizing dye (S-3) (AgI: 6.0 mol %, average grain size: 0.4 μm) | 0.15 |
| Gelatin | 0.93 |
| 6th layer (2nd green-sensitive layer) | |
| Magenta coupler (C-3) | 0.15 |
| Antifading agent (A-3) | 0.040 |
| Antifading agent (A-4) | 0.070 |
| High boiling solvent (O-1) | 0.11 |
| AgBrI spectrally sensitized by a green sensitizing dye (S-3) (AgI: 6.0 mol %, average grain size: 0.7 μm) | 0.15 |
| Gelatin | 0.83 |
| 7th layer (2nd intermediate layer) | |
| Yellow colloidal silver | 0.20 |
| Antistain agent (AN-1) | 0.014 |
| Antistain agent (AN-2) | 0.046 |
| High boiling solvent (O-1) | 0.096 |
| Gelatin | 0.90 |
| 8th layer (1st blue-sensitive layer) | |
| Yellow coupler (C-4) | 0.24 |
| Antifading agent (A-1) | 0.096 |
| Antifading agent (A-5) | 0.048 |
| High boiling agent (O-3) | 0.048 |
| AgBrI spectrally sensitized by a blue-sensitizing dye (s-4) (AgI: 6.0 mol %, average grain size: 0.4 μm) | 0.15 |
| Gelatin | 0.95 |
| 9th layer (2nd blue-sensitive layer) | |
| Yellow couler (C-4) | 0.32 |
| Antifading agent (A-1) | 0.13 |
| Antifading agent (A-5) | 0.064 |
| High boiling solvent (O-3) | 0.064 |
| AgBrI spectrally sensitized by a blue-sensitizing dye (S-4) (Em-A) | 0.13 |
| Gelatin | 0.93 |
| 10th layer (ultraviolet absorbing layer) | |
| Ultraviolet absorbing agent (U-1) | 0.45 |
| Ultraviolet absorbing agent (U-2) | 0.15 |
| Antistain agent (AN-1) | 0.033 |
| High boiling solvent (O-3) | 0.037 |
| Gelatin | 1.87 |
| 11th layer (protective layer) | |
| Gelatin | 0.50 |

In addition to the above compounds, a surfactant, hardener, anti-irradiation dye were used in these layers.

Coupler C-1

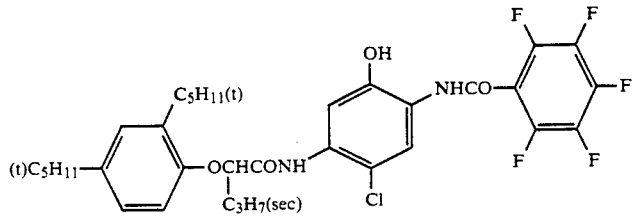

-continued
Coupler C-2
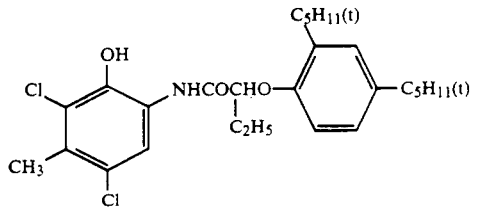
Coupler C-3
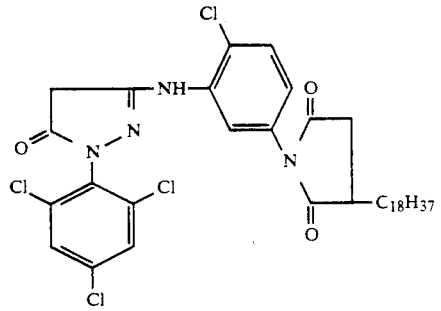
Coupler C-4
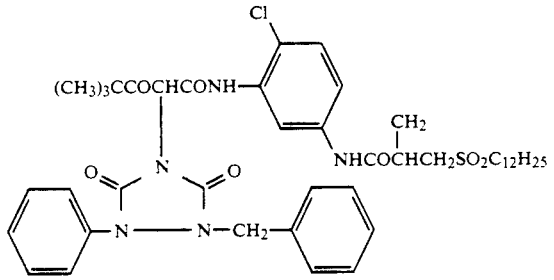
A-1
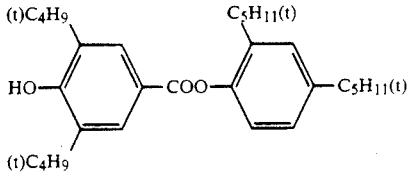
A-2
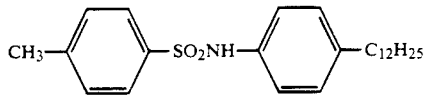
A-3
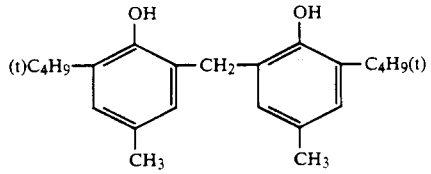
A-4
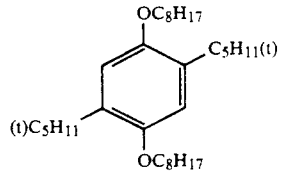
A-5
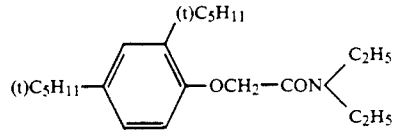

-continued

Antistain agent AN-1

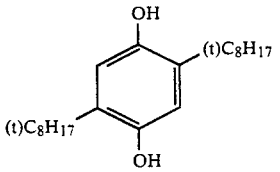

Antistain agent AN-2

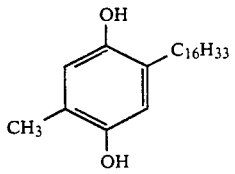

O-1: di-2-ethylhexyl phthalate
O-2: di-isodecyl phthalate
O-3: di-nonyl phthalate Ultraviolet absorbing agent U-1

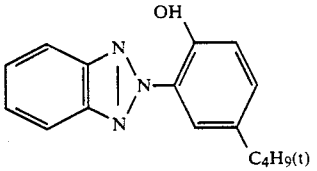

Ultraviolet absorbing agent U-2

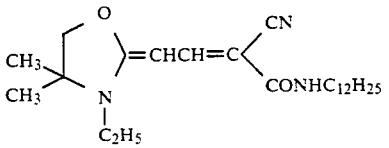

Sensitizing dye S-1

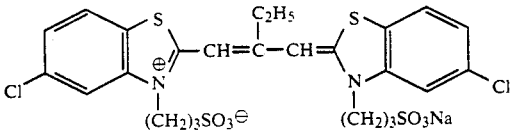

Sensitizing dye S-2

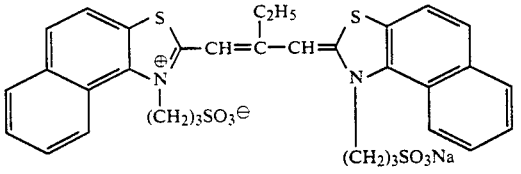

Sensitizing dye S-3

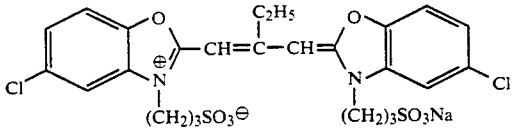

Sensitizing dye S-4

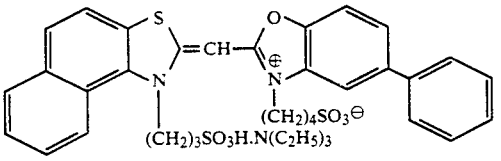

Next, in contrast to the comparative sample 41, the samples 42 through 44 were prepared by changing Em-A of the 9th layer to the emulsions shown in Table 8.

TABLE 8

| Sample No. | Emulsion used in 9th layer |
|---|---|
| 201 | Em-A |

TABLE 8-continued

| Sample No. | Emulsion used in 9th layer |
|---|---|
| 202 | Em-B |
| 203 | Em-1 |
| 204 | Em-2 |

Each of the samples was subjected to the pressure resistance test in the same manner as in Example 12.

Subsequently, these samples were exposed to a white light via an optical wedge and then developed in the following processes.

| | |
|---|---|
| 1st developing (black and white developing) | 1 min. and 15 sec. (38° C.) |
| Washing | 1 min. and 30 sec |
| Light fogging | more than 100 lux, more than 1 sec. |
| 2nd developing (color developing) | 2 min. and 15 sec. (38° C.) |
| Washing | 45 sec. |
| Bleach-fixing | 2 min. (38° C.) |
| Washing | 2 min. and 15 sec. |
| 1st developing solution | |
| Potassium sulfite | 3.0 g |
| Sodium thiocyanate | 1.0 g |
| Sodium bromide | 2.4 g |
| Potassium iodide | 8.0 mg |
| Potassium hydroxide (48%) | 6.2 m |
| Potassium carbonate | 14 g |
| Sodium hydrogencarbonate | 12 g |
| 1-phenyl-4-methyl-4-hydroxymethyl-3-pyrazolidone | 1.5 g |
| Hydroquinone monosulfonate | 23.3 g (pH = 9.65) |
| Color developing solution | |
| Benzyl alcohol | 14.6 m |
| Ethylene glycol | 12.6 m |
| Potassium carbonate (anhydrous) | 26 g |
| Potassium hydroxide | 1.4 g |
| Sodium sulfite | 1.6 g |
| 3,6-dithiaoctane-1,8-diol | 0.24 g |
| Hydroxylamine sulfate | 2.6 g |
| 4-N-ethyl-N-(β-methanesulfonamidethyl)-3-methyl-4-aminoaniline sulfate | 5.0 g |
| Water to make | 1000 m |
| Bleach-fixing solution | |
| Ammonium ferric ethylenediamine tetracetate (1.56 mol solution) | 115 m |
| Sodium metabisulfite | 15.4 g |
| Ammonium thiosulfate (58% solution) | 126 m |
| 1,2,4-triazole-3-thiol | 0.4 g |
| Water to make | 1000 m (pH = 6.5) |

The developed samples were evaluated in the same manner as in Example 10. The results are shown in Table 9.

TABLE 9

| Sample No. | Relative sensitivity | Scratch test ($\Delta D_{1.0}$) 10 g | 20 g | 40 g | Bending test Inward bending | Outward bending |
|---|---|---|---|---|---|---|
| 201 (Comparison) | 100 | +0.06 | +0.08 | +0.13 | b | c |
| 202 (Comparison) | 108 | +0.11 | +0.14 | +0.21 | c | c |
| 203 (Invention) | 110 | +0.02 | +0.04 | +0.04 | a | b |
| 204 (Invention) | 108 | +0.02 | +0.02 | +0.05 | a | a |

a. no density difference is observed.

b. a slight density difference is observed.

c. a density difference is observed.

As shown in Table 9, the constitution of the invention can substantially improve the pressure resistance with the high sensitivity unchanged, even in a silver halide light-sensitive material which uses a polyethylene laminated paper support.

What is claimed is:

1. A photographic silver halide emulsion comprising silver halide twinned crystal grains having a higher iodide content in an inner core than in an outer shell thereof, wherein 50% or more of the total grain projection area comprises of said silver halide grains having a ratio of grain diameter to grain thickness of 5 or less;

said emulsion is monodispersion;

said silver halide grains provide an X-ray diffraction pattern having a signal with a single peak when a diffraction pattern of a (420) face of said grains is measured with an X-ray diffractometer using Kα ray of Cu; and the width of said peak at a height of 0.13 times the maximum peak height, based on the signal intensity, is 1.5 degrees or less in a diffraction angle 2θ where θ is the Bragg angle.

2. A silver halide emulsion of claim 1, wherein said silver halide twinned crystal grains each have two or more parallel twin planes.

3. A silver halide emulsion of claim 2, wherein said twinned crystal grains amount to 50% or more by number of total grains.

4. A silver halide emulsion of claim 1, wherein said twinned crystal grains amount to 50% or more by number of total grains.

5. A silver halide emulsion of claim 1, wherein said monodispersed emulsion has a coefficient of variation of 20% or less.

6. A silver halide emulsion of claim 1, wherein said width has a ratio of length-of-line-segment-A8 to length-of-line-segment-BA' of 1 or less, wherein when a horizontal line is drawn at a height of 0.13 times the maximum peak height of said signal, a line segment cut from the horizontal line by said signal is denoted by AA' and an intersection point made by AA' and a vertical line drawn downward from peak point is denoted by B, provided that the line AA' is drawn from a lower angle side of the diffraction angle to a higher angle converted side.

7. A sliver halide emulsion of claim 1, wherein said silver halide twinned crystal grains have an average silver iodide content of less than 6 mol %.

8. A silver halide emulsion of claim 7, wherein said iodide content is within the range of 1 to 4 mol %.

9. A silver halide emulsion of claim 1, wherein said silver halide twinned crystal grains are silver iodobromide grains having silver iodide localized in the internal portion of the grain.

10. A silver halide photographic light-sensitive material comprising a support having thereon a red-sensitive silver halide emulsion layer, a green-sensitive silver halide emulsion layer and a blue-sensitive silver halide emulsion layer, wherein at least one of said color-sensitive layers comprises a silver halide emulsion as claimed in claim 1.

11. A silver halide color photographic light-sensitive material of claim 10, wherein at least one of the remaining color-sensitive layers comprises a silver halide emulsion comprising silver halide regular crystal grains.

12. A silver halide photographic light-sensitive material comprising a support having thereon a red-sensitive silver halide emulsion layer, a green-sensitive silver halide emulsion layer and a blue-sensitive silver halide emulsion layer, wherein the light-sensitive layer furthest form the support comprises a silver halide emulsion as claimed in claim 1.

13. The emulsion of claim 1 wherein said core contains 18 to 45 mol % of silver iodide.

* * * * *